US008307465B2

(12) United States Patent
French et al.

(10) Patent No.: US 8,307,465 B2
(45) Date of Patent: Nov. 13, 2012

(54) GARMENT POCKET FOR CARRYING AN OBJECT IN A CONCEALED STATE

(75) Inventors: Jay French, New Cumberland, PA (US); Jared M. French, New Cumberland, PA (US)

(73) Assignee: CCW Breakaways LLC, New Cumberland, PA (US)

( * ) Notice: Subject to any disclaimer, the term of this patent is extended or adjusted under 35 U.S.C. 154(b) by 489 days.

(21) Appl. No.: 12/549,212

(22) Filed: Aug. 27, 2009

(65) Prior Publication Data

US 2010/0050312 A1 Mar. 4, 2010

Related U.S. Application Data

(63) Continuation-in-part of application No. 12/242,082, filed on Sep. 30, 2008, and a continuation-in-part of application No. 12/430,028, filed on Apr. 24, 2009.

(60) Provisional application No. 61/190,598, filed on Aug. 29, 2008.

(51) Int. Cl.
*A41D 27/20* (2006.01)

(52) U.S. Cl. ..... 2/250; 2/253

(58) Field of Classification Search ..... 2/247–252, 2/253, 254, 269, 270, 89, 86, 102, 48, 94
See application file for complete search history.

(56) References Cited

U.S. PATENT DOCUMENTS 309,292 A 12/1884 Browne
1,116,643 A 11/1914 Strobel
1,120,190 A 12/1914 Gaskill
1,146,685 A * 7/1915 Bernstein ..... 2/253
1,161,435 A * 11/1915 Baker ..... 2/253
1,191,339 A 7/1916 Noye
1,255,497 A * 2/1918 Ankele ..... 2/254
1,479,707 A * 1/1924 Foisy ..... 2/87
1,970,110 A 8/1934 Vaccaro
2,251,576 A * 8/1941 Puodis ..... 2/253
2,262,402 A 11/1941 Oppenheimer
2,263,546 A 11/1941 Goldsmith et al.
2,283,362 A 5/1942 Hamilton
2,323,390 A 7/1943 Friedman
2,472,286 A * 6/1949 Drasnin ..... 2/247
2,489,148 A 11/1949 Ludwig
2,489,868 A * 11/1949 Dowling et al. ..... 2/253
2,527,224 A 10/1950 Landy
2,557,445 A 6/1951 Lewallen
2,593,795 A 4/1952 Rhoads et al.
2,604,627 A 7/1952 Abbott
2,705,326 A * 4/1955 Lahnstein et al. ..... 2/83
2,732,560 A 1/1956 Frederiksen, Sr.
2,810,132 A 10/1957 Nicholson
3,000,012 A * 9/1961 Neil ..... 2/94
3,077,604 A 2/1963 Colangelo
(Continued)

*Primary Examiner* — Alissa L Hoey
(74) *Attorney, Agent, or Firm* — McNees Wallace & Nurick LLC

(57) ABSTRACT

A garment pocket configured to carry, in a concealed and readily-accessible state, a handgun or other object is disclosed. The garment pocket is configured to be folded to yield and maintain at least one additional configuration. The garment pocket can be folded to assume and maintain either a first folded configuration, or a second folded configuration. The garment pocket in the first folded configuration is suitable for carrying, in an ergonomic position, a handgun having, for example, a medium-to-long barrel portion, whereas the garment pocket in the second folded configuration is suitable for carrying, in an ergonomic position, a handgun having, for example, a relatively short barrel portion.

28 Claims, 22 Drawing Sheets

U.S. PATENT DOCUMENTS 3,220,017 A 11/1965 Morton
3,537,108 A 11/1970 Daniels
3,751,731 A 8/1973 Bennett
3,782,614 A 1/1974 Campisi
4,077,067 A 3/1978 Kozdal
4,123,804 A 11/1978 Michael et al.
4,138,745 A 2/1979 Greenspan
4,149,275 A * 4/1979 Sanchez ..... 2/269
4,156,295 A 5/1979 LeRoy
4,200,938 A * 5/1980 LeTourneau ..... 2/269
4,235,356 A 11/1980 Atchisson
4,262,832 A 4/1981 Perkins
4,637,075 A 1/1987 Ingrisano et al.
4,651,355 A 3/1987 White
4,741,465 A 5/1988 Johnson
4,791,681 A 12/1988 Dean
4,882,786 A 11/1989 Gross
4,898,310 A 2/1990 Remington
4,966,320 A 10/1990 DeSantis et al.
4,966,321 A 10/1990 Outlaw
4,998,654 A 3/1991 Bruzek et al.
5,054,671 A 10/1991 Else
5,082,157 A 1/1992 Emerson-Santos
5,215,238 A 6/1993 Baruch
5,421,032 A 6/1995 Murphy
5,445,303 A 8/1995 Cawile, Jr.
5,535,453 A * 7/1996 Howard ..... 2/269
5,539,932 A * 7/1996 Howard ..... 2/269
5,555,566 A * 9/1996 Kuhn ..... 2/247
5,588,154 A 12/1996 Blauer et al.
5,638,549 A 6/1997 Thomas
5,692,237 A 12/1997 Bennett
5,749,098 A * 5/1998 Evans ..... 2/123
5,771,496 A 6/1998 Wood
5,832,536 A 11/1998 Kramer
5,884,338 A 3/1999 Golde
5,931,358 A 8/1999 Rogers
5,940,883 A * 8/1999 Daoust ..... 2/102
6,131,198 A 10/2000 Westrick
6,154,888 A 12/2000 Krohn
6,264,079 B1 7/2001 Skaggs
6,374,421 B1 * 4/2002 Cleary ..... 2/254
6,685,066 B2 2/2004 Cragg
6,763,527 B1 7/2004 Rivoli et al.
6,769,139 B1 8/2004 Goldkind
6,926,182 B2 8/2005 Cragg
6,978,484 B2 12/2005 Donlan et al.
6,986,164 B1 1/2006 Morales
7,003,810 B2 2/2006 Goldkind
7,058,987 B2 6/2006 Salazar
7,152,247 B2 12/2006 Parsons
7,631,368 B1 12/2009 Samson
7,636,949 B1 * 12/2009 Shooshan ..... 2/48
7,637,218 B1 12/2009 Burton
7,681,255 B2 3/2010 Morales et al.
7,743,430 B2 6/2010 Jennings et al.
2003/0205595 A1 11/2003 Young
2005/0015844 A1 1/2005 Parsons
2005/0017034 A1 1/2005 Ausanio
2005/0066424 A1 3/2005 Salazar
2005/0223466 A1 10/2005 Jennings et al.
2005/0235398 A1 10/2005 Yoo
2007/0250980 A1 11/2007 Pellerin
2008/0125842 A1 5/2008 Petitt
2008/0263742 A1 10/2008 Vaughn
2009/0025117 A1 1/2009 French
2009/0172861 A1 7/2009 Tomlinson et al.
2009/0265835 A1 10/2009 French et al.
2010/0017943 A1 1/2010 Morales et al.
2010/0319108 A1 12/2010 King
2011/0030126 A1 2/2011 French
2011/0119800 A1 * 5/2011 Garrido et al. ..... 2/2.15

* cited by examiner

GARMENT POCKET FOR CARRYING AN OBJECT IN A CONCEALED STATE

CROSS-REFERENCE TO RELATED APPLICATIONS

This application claims the benefit of U.S. Provisional Application No. 61/190,598, filed Aug. 29, 2008; is a continuation-in-part of U.S. application Ser. No. 12/242,082, filed Sep. 30, 2008; and is a continuation-in-part of U.S. application Ser. No. 12/430,028, filed Apr. 24, 2009.

FIELD OF THE INVENTION

The present invention is directed to a garment pocket and, more specifically, to a garment pocket configured to carry, in a concealed and readily-accessible state, a handgun or other object (e.g., pepper spray, pocket tool, handcuffs, dagger, passport or other identification, wallet, valuables, etc.).

BACKGROUND OF THE INVENTION

Law-enforcement personnel are usually authorized to carry protection devices (e.g., handguns, stun guns, pepper sprays, etc.) or other objects (e.g., pocket tool, handcuffs, dagger, passport or other identification, wallet, valuables, etc.). However, when working undercover or on duty in plain clothes, law-enforcement personnel can have a problem with telegraphing, which is sometimes referred to as "profiling" or "mapping." As used broadly herein, "telegraphing" is the tendency for a concealed object (e.g., a handgun) to show through the concealing garment, rendering the concealed object readily detectable by others. Known carrying devices worn by law-enforcement personnel do not sufficiently minimize telegraphing. Furthermore, when the law-enforcement officer or wearer is wearing only one or two layers of clothing, such as when the wearer is dressed appropriately for warm weather or for working indoors in a temperature-controlled environment, the presence of the carrying device becomes even more evident. In many instances, the carrying device, itself, will telegraph the potential presence of the object(s). Additionally, a carrying device such as a holster is generally limited in that the holster can properly carry only one type of handgun, leading law-enforcement personnel to require a different holster for each type of handgun they possess.

Accordingly, there is a need for a device that can carry, in a concealed and readily-accessible state, a handgun or other object. Additionally, there is a need for a device that is suitable for carrying, in a concealed and readily-accessible state, a variety of handgun types.

SUMMARY OF THE INVENTION

In accordance with one aspect of the invention, a pocket for a garment is disclosed. The pocket includes a first portion and a second portion attached to the first portion to form a partially-enclosed space. The partially-enclosed space includes a region partially defined by (1) a first line corresponding substantially to a line of flexion of a hip joint of a wearer of the garment, (2) a second line corresponding substantially to a centerline of a thigh of a wearer of the garment, and (3) a third line corresponding substantially to an inseam of a wearer of the garment. The region is configured and disposed to substantially conceal an object (e.g., a handgun) stored in the region from a person viewing the garment. The region includes a partially-enclosed subspace that is partially defined by (1) an inner edge disposed proximate to the inseam of the wearer of the garment, (2) a base edge extending from the inner edge, and (3) a seam connecting the first portion and the second portion. The seam, which extends from the base edge in a direction substantially parallel to the inner edge, is disposed in the partially-enclosed space and is configured and disposed to aid in orienting the object in the region. The pocket additionally includes a retaining mechanism configured and disposed to adjust a position of the base edge and thereby adjust the size of an accessible portion of the partially-enclosed subspace.

In accordance with another aspect of the present invention, a garment for a person is disclosed. The garment includes a pocket, which includes a partially-enclosed space. The partially-enclosed space includes a region partially defined by (1) a first line corresponding substantially to a line of flexion of a hip joint of a wearer of the garment, (2) a second line corresponding substantially to a centerline of a thigh of a wearer of the garment, and (3) a third line corresponding substantially to an inseam of a wearer of the garment. The region is configured and disposed to substantially conceal an object (e.g., a handgun) stored in the region from a person viewing the garment. The region includes a partially-enclosed subspace that is partially defined by (1) an inner edge disposed proximate to the inseam of the wearer of the garment, (2) a base edge extending from the inner edge, and (3) a seam. The seam, which extends from the base edge in a direction substantially parallel to the inner edge, is disposed in the partially-enclosed space and is configured and disposed to aid in orienting the object in the region. The pocket additionally includes a retaining mechanism configured and disposed to adjust a position of the base edge and thereby adjust the size of an accessible portion of the partially-enclosed subspace.

In accordance with yet another aspect of the present invention, a method of making a garment for a person is disclosed. The method includes providing at least one layer of material. The method further includes forming a pocket having an opening and a partially-enclosed space from the at least one layer of material. The pocket includes a first layer, a second layer, an exterior surface, a base edge, an inner edge, and a region. The region is defined approximately by (1) a first line corresponding substantially to a line of flexion corresponding to a hip joint of a wearer of the garment, (2) a second line corresponding substantially to a centerline of a thigh of the wearer of the garment, and (3) a third line corresponding substantially to an inseam of a wearer of the garment. The region is configured and disposed to substantially conceal an object (e.g., handgun) disposed in the region from a person viewing the garment. The method includes attaching a first exterior surface portion and a second exterior surface portion to the exterior surface, the first exterior surface portion being proximate to or adjacent the base edge and being configured and disposed to connect to the second exterior surface portion when the pocket is folded along an axis adjacent or intersecting the seam. The method includes connecting the first layer and the second layer with a seam extending from the base edge in a direction substantially parallel to the inner edge, the seam being configured and disposed to aid in orienting the object in the region. The method further includes attaching a retaining mechanism to the exterior surface, the retaining mechanism being configured and disposed to attach the first exterior surface portion to the second exterior surface portion when the pocket is folded along an axis adjacent or intersecting the seam. Additionally, the method includes attaching the pocket to the garment.

Among the advantages of the present invention are that the wearer can carry, in a concealed and readily-accessible state, a handgun or other object (e.g., pepper spray, pocket tool, handcuffs, dagger, passport, wallet, valuables, etc.). The present invention minimizes telegraphing of the handgun or other object and also renders it extremely difficult for a person other than the wearer to access the handgun or other object carried therein without the wearer's knowledge. Additionally, it is difficult for the wearer to lose possession of the handgun or other object carried therein, including even while the wearer is engaging in strenuous physical activity (e.g., fighting, running, jumping). The present invention does not significantly compromise the wearer's freedom of movement because the handgun or other object does not intersect (1) the line of flexion of the wearer's hip joint or (2) the line of flexion of the wearer's knee joint. For example, the ability of the wearer to kneel, run, and sit is not significantly compromised. The wearer also benefits from having "constant recognition" or "constant feel" that the handgun or other object is on his person because the object is carried adjacent to his inner thigh, increasing the possibility that the wearer would notice if the object went missing and decreasing the possibility that an attempt by an opponent to seize or "take-away" the object would be successful.

An advantage of at least some embodiments of the garment pocket of the present invention is that the garment pocket can optionally be folded to assume and maintain either a first folded configuration or a second folded configuration. The garment pocket in the first folded configuration can carry, in an ergonomic position, a handgun having, for example, a medium-to-long barrel portion, whereas the garment pocket in the second folded configuration can carry, in an ergonomic position, a handgun having, for example, a relatively short barrel portion. Therefore, as a result of the first folded configuration and the second folded configuration, the garment pocket can carry several different types of handguns, and represents a significant and economical departure from the prevailing "one holster per handgun type" paradigm.

Other features and advantages of the present invention will be apparent from the following more detailed description of the preferred embodiment, taken in conjunction with the accompanying drawings which illustrate, by way of example, the principles of the invention.

BRIEF DESCRIPTION OF THE DRAWINGS

Wherever possible, the same reference numbers are used throughout the drawings to refer to the same or like parts.

DETAILED DESCRIPTION OF THE INVENTION

Figure 1:
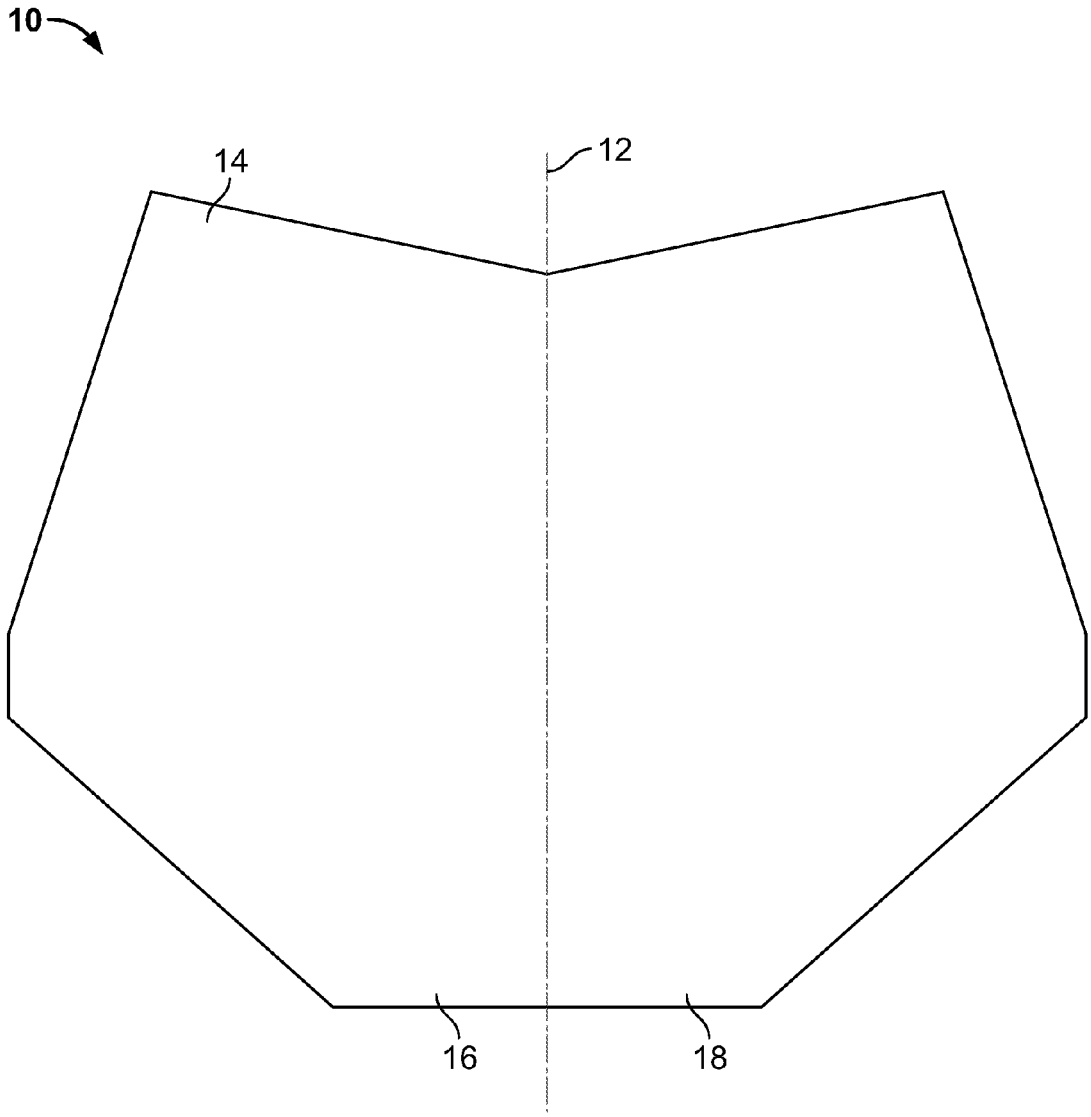
FIG. 1 is a front plan view of an exemplary embodiment of an unsewn garment pocket of the present invention.
Figure 2:
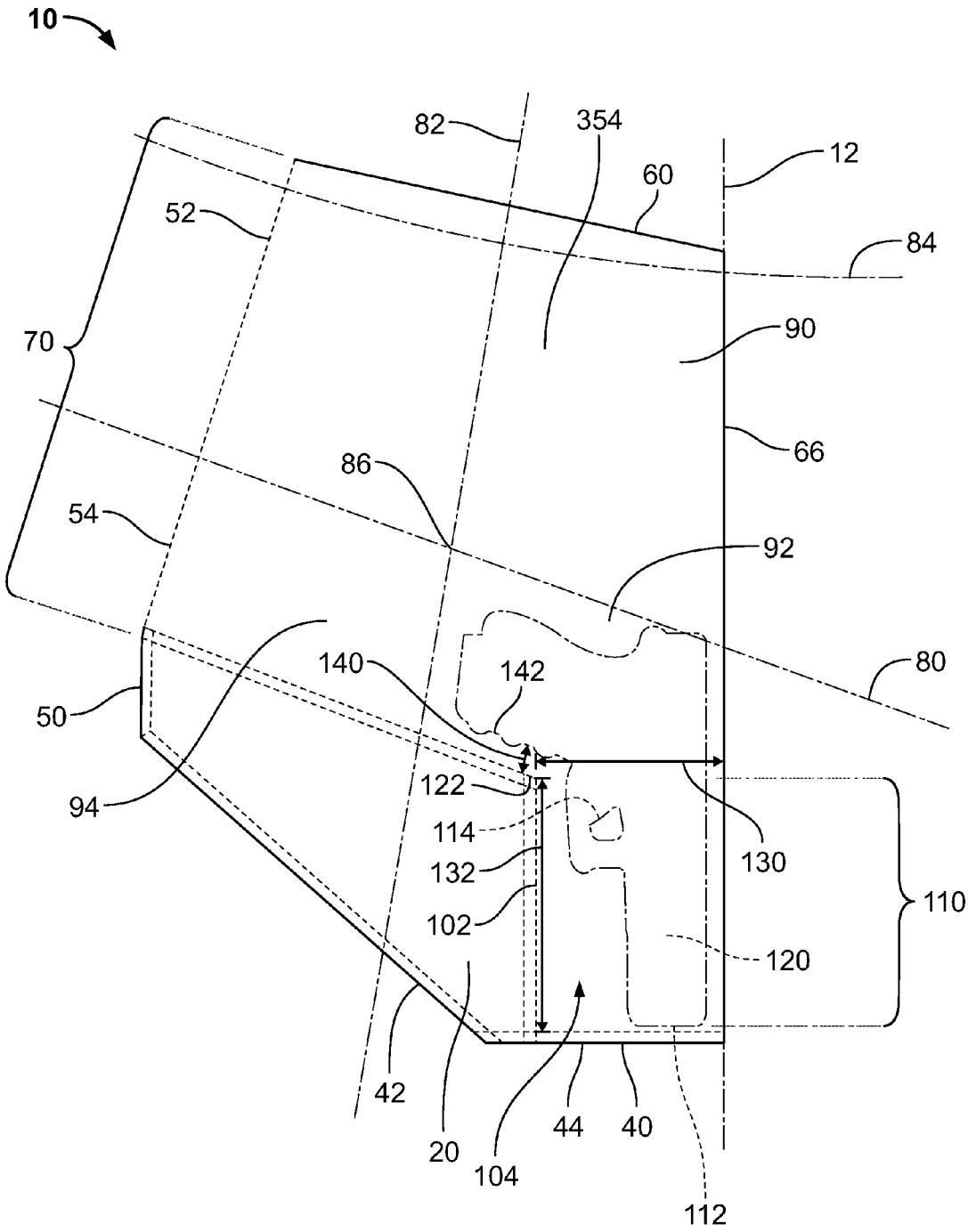
FIG. 2 is a front plan view of an exemplary embodiment of a sewn garment pocket of the present invention showing a handgun having a relatively long barrel portion being carried therein.

FIGS. 1 and 2 show different views of an exemplary embodiment of a garment pocket. Pocket 10, which is shown configured for access by a wearer's right hand (see FIG. 2), is intended for incorporation into a garment (e.g., pants, shorts, skirts). In another embodiment, pocket 10 can be configured for access by a wearer's left hand. For illustrative purposes, FIG. 1 shows pocket 10 before the actual pocket is formed, and FIG. 2 shows a front view of pocket 10 after the actual pocket has been formed, such as by stitching, sewing, or other suitable attachment or connection techniques. As shown in FIGS. 1 and 2, pocket 10 can be formed, for example, by folding a single sheet of pliable material 14 along axis 12. Suitable examples of a pliable material include, without limitation, cotton, ripstop cloth, and ripstop nylon. In an alternate embodiment, pocket 10 can be manufactured using two or more pieces of pliable material. Referring to FIG. 1, first section 16 of pliable material 14, which is defined in part by axis 12, serves as the inner portion or part of pocket 10, i.e., the part of pocket 10 that is intended to be in closest proximity to the wearer's body. Second section 18 of pliable material 14, which is defined in part also by axis 12, serves as outer portion or part 20 (see FIG. 2) of pocket 10. In another exemplary embodiment, the location of first section 16 and second section 18 may be reversed for a "left hand" pocket. Outer part 20 is shown in FIG. 2, but the inner part is not, because outer part 20 and inner part 260 (see FIG. 6) are substantially congruent. Upon formation of the actual pocket, as shown in FIG. 2, the surface of first section 16 shown in FIG. 1 serves as a first interior surface of pocket 10, and the surface of second section 18 shown in FIG. 1 serves as an (opposing) second interior surface of pocket 10. These two opposing interior surfaces border the partially enclosed space defined by the pocket 10.

Referring to FIG. 2, outer part 20 is fastened (e.g., seamed or sewn) to the corresponding inner part at least along (1) first segment 40 and second segment 42 of base edge 44, (2) segment 50 of outer edge 54, and (3) top edge 60. In another embodiment, outer part 20 and corresponding inner part 260 may be derived from two or more pieces of pliable material. In embodiments using two or more pieces of pliable material, outer part 20 is additionally fastened to the corresponding inner part along inner edge 66.

Pocket 10, i.e., outer part 20 and corresponding inner part, can be fastened to the waistline of a garment along top edge 60. As used herein, "waistline" is defined as the part of a garment that generally covers the waistline of the person and/or an adjoining area above or below the waistline. Corresponding inner part (but not outer part 20) can be fastened to the garment along segment 52 of outer edge 54, which coincides with pocket opening 70. Both outer part 20 and the corresponding inner part are intended to be fastened to the garment along segment 50 of outer edge 54. Segment 50 can be used to maintain pocket 10 in a proper position following incorporation into the garment, especially as pocket 10 is generally not fastened to the garment along inner edge 66 or base edge 44.

Figure 9:
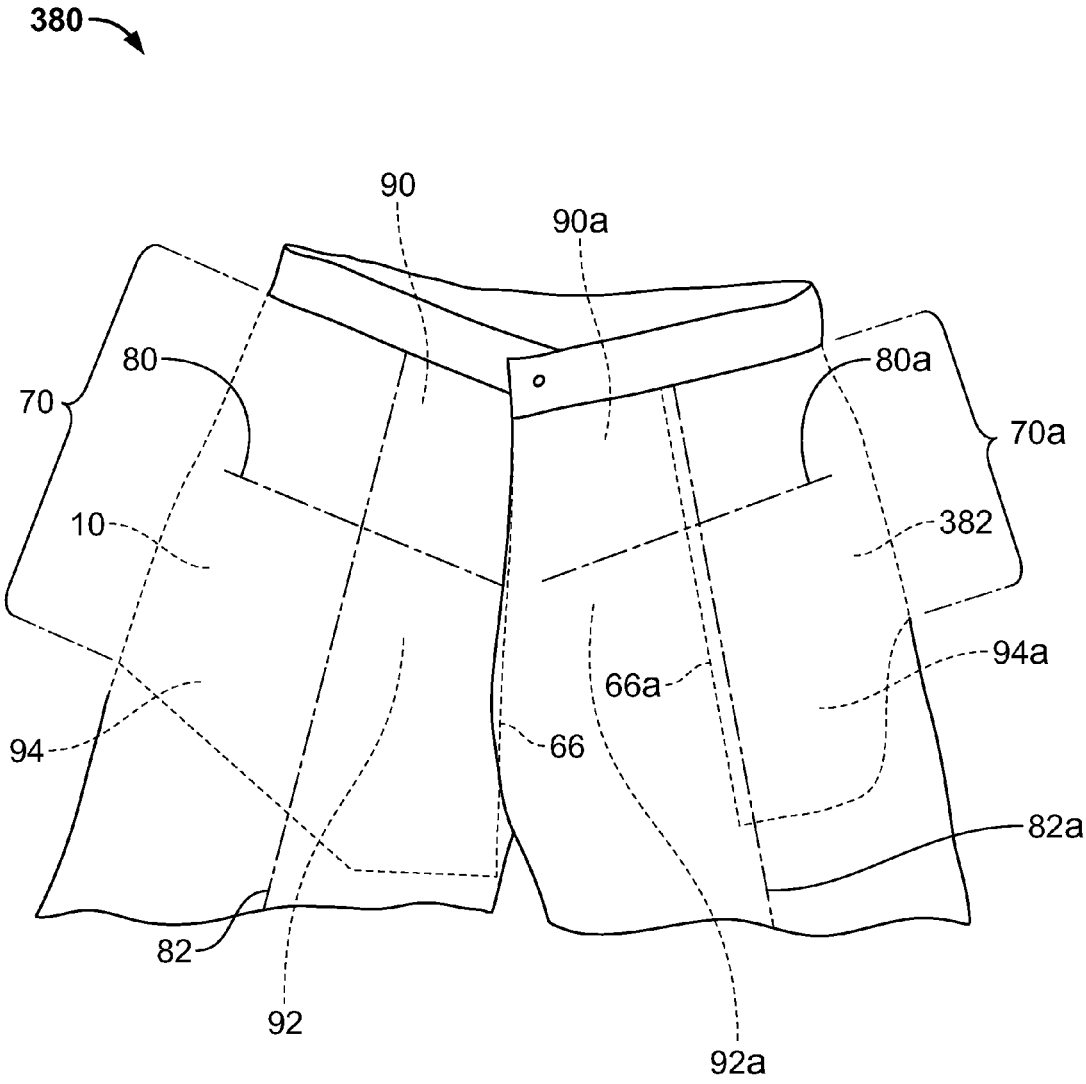
FIG. 9 is a partial front view of a pair of pants having an exemplary embodiment of the garment pocket incorporated therein.

Pocket 10 can be incorporated into a garment (e.g., pants) such that pocket 10 is oriented as shown in FIG. 9, for example. Line 80 through pocket 10 represents approximately the line of flexion corresponding to the wearer's hip joint. Line 82 through pocket 10 represents approximately the centerline of the wearer's thigh. Line 84 through pocket 10 represents approximately the wearer's waistline. Origin point 86 is defined by the intersection of line 80 and line 82.

Assuming that line 80 and line 82 correspond respectively to the x-axis and y-axis of a Cartesian coordinate system, pocket 10 can be considered as having four quadrant-like regions, three of which are described below. A first region 90 is defined by (1) the line of flexion corresponding to the wearer's hip joint (i.e., line 80); (2) the centerline of the wearer's thigh (i.e., line 82); (3) inner edge 66 of pocket 10, which corresponds approximately to the line defined by the wearer's inseam; and (4) line 84, which corresponds approximately to the wearer's waistline. A second region 92 is defined by (1) the line of flexion corresponding to the wearer's hip joint (i.e., line 80); (2) the centerline of the wearer's thigh (i.e., line 82); (3) inner edge 66 of pocket 10, which corresponds approximately to the line defined by the wearer's inseam; and (4) base edge 44, which is located above the line of flexion corresponding to the wearer's knee joint, and includes first segment 40. A third region 94 is defined by (1) the line of flexion corresponding to the wearer's hip joint (i.e., line 80); (2) the centerline of the wearer's thigh (i.e., line 82); (3) outer edge 54; and (4) second segment 42 of base edge 44.

Pocket 10 includes first seam 102, which is substantially parallel to inner edge 66 and is substantially perpendicular to segment 40 of base edge 44. First seam 102, inner edge 66, and first segment 40 define receiving zone 104, which is configured to receive barrel portion 110, muzzle 112, and trigger guard 114 of a handgun (e.g., handgun 120). Receiving zone 104 (also referred to herein as "partially-enclosed subspace") is dimensioned to aid in maintaining handgun 120 in second region 92 and to provide an ergonomic orientation of handgun 120. Ergonomic orientation refers to one or more of (1) barrel portion 110 being substantially adjacent to inner edge 66; (2) muzzle 112 being substantially adjacent to first segment 40 of base edge 44; and/or (3) trigger guard 114 being proximal to the end of first seam 102 opposite base edge 44 (i.e., first end 122). Even when a handgun is carried in the ergonomic orientation, the grip of the handgun nevertheless may encroach slightly into third region 94 by intersecting the centerline of the wearer's thigh (line 82). This encroachment by the grip is more common when a relatively large handgun is carried in the ergonomic orientation. Thus, it can be stated that a handgun, when carried in the ergonomic orientation, is stored (at least) substantially in second region 92. Referring still to FIG. 2, width 130 of receiving zone 104 is defined by the approximate distance between inner edge 66 and first seam 102. First seam 102 and inner edge 66 restrict lateral movement and rotation of handgun 120, maintaining barrel portion 110 in an orientation substantially adjacent to inner edge 66. If width 130 is too great, barrel portion 110 can move and not maintain such adjacent orientation. Conversely, if width 130 is too small, the wearer may experience difficulty in inserting barrel portion 110 and trigger guard 114 into receiving zone 104.

Length 132 of receiving zone 104 is defined by the approximate length of first seam 102. As shown in FIG. 2, the length of first seam 102 can be selected such that, once handgun 120 is inserted into receiving zone 104, the muzzle 112 of handgun 120 rests on base edge 44 and forms a finger gap 140 between grip 142 of handgun 120 and first end 122 of first seam 102. Finger gap 140 enables the wearer to grip and remove handgun 120 from pocket 10 more readily. The wearer, in preparing to remove handgun 120 from pocket 10, does not have to force his fingers between grip 142 and first end 122 of first seam 102 in order to grasp grip 142. Accordingly, finger gap 140 and the length of barrel portion 110 of handgun 120 are factors in selecting the length of first seam 102.

Pocket 10 could be modified to carry a handgun having an even longer barrel portion than barrel portion 110 of handgun 120 by extending inner edge 66, first seam 102, and base edge 44 downward (i.e., in the direction of the wearer's knee), increasing length 132 of receiving zone 104. However, in one embodiment neither inner edge 66, first seam 102, nor base edge 44 may be extended so far downward that they meet or intersect the line of flexion of corresponding to the wearer's knee joint. Similarly, pocket 10 could be modified to carry a handgun having a shorter barrel portion than barrel portion 110 of handgun 120 by shortening (1) first seam 102, or (2) first seam 102 and inner edge 66. In one embodiment, the length of inner edge 66 may be shortened more than first seam 102 is shortened. However, as explained later, pocket 10 may include a combination of features that allow a user to properly carry therein a handgun having a shorter barrel portion, without having to physically shorten first seam 102 or inner edge 66.

Figure 3:
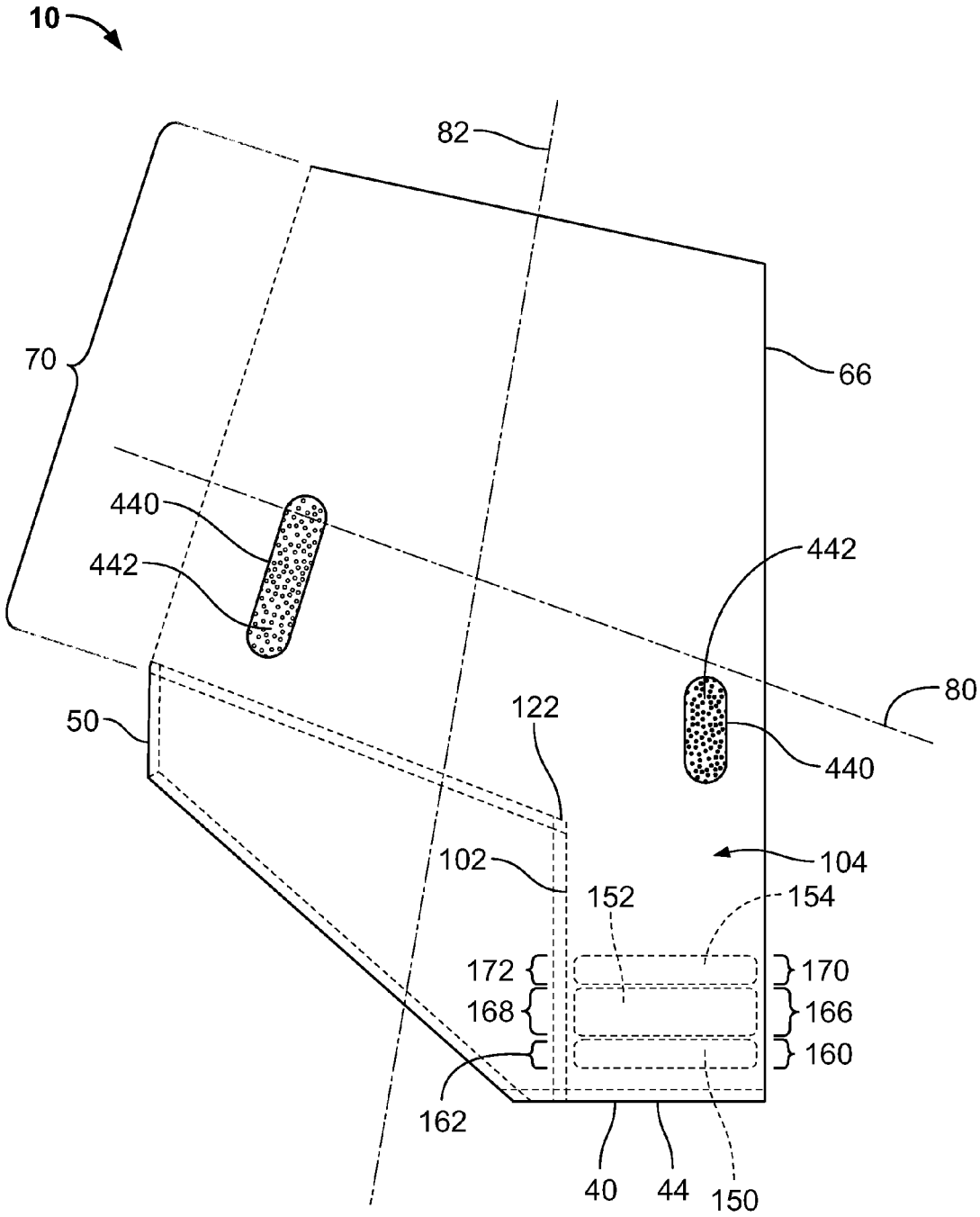
FIG. 3 is a front plan view of an exemplary embodiment of a sewn garment pocket of the present invention showing retaining devices for adjusting pocket depth.

Referring to FIG. 3, receiving zone 104 can be described as including three non-overlapping quadrilateral sub-regions: a first receiving-zone sub-region 150, a second receiving-zone sub-region 152, and a third receiving-zone sub-region 154. Each of these sub-regions 150, 152, 154 may be defined, in part, by a respective portion of inner edge 66 and a respective opposing portion of first seam 102. More particularly, first receiving-zone sub-region 150 may be defined in part by a first portion 160 of inner edge 66 and a first opposing portion 162 of first seam 102. Second receiving-zone sub-region 152 may be defined in part by a second portion 166 of inner edge 66 and a second opposing portion 168 of first seam 102. Third receiving-zone sub-region may be defined in part by a third portion 170 of inner edge 66 and a third opposing portion 172 of first seam 102. Receiving-zone sub-regions 150, 152, 154 vary respectively in proximity to first segment 40 of base edge 44. More specifically, first receiving-zone sub-region 150 is more proximate to first segment 40 than either second receiving-zone sub-region 152 or third receiving-zone sub-region 154. Second receiving-zone sub-region 152 is more proximate to first segment 40 than third receiving-zone sub-region 154. Features 440 and 442, which relate to an anti-telegraphing device 420 (see, e.g., FIGS. 12A-12C) are identified and described later in this specification.

Figure 4:
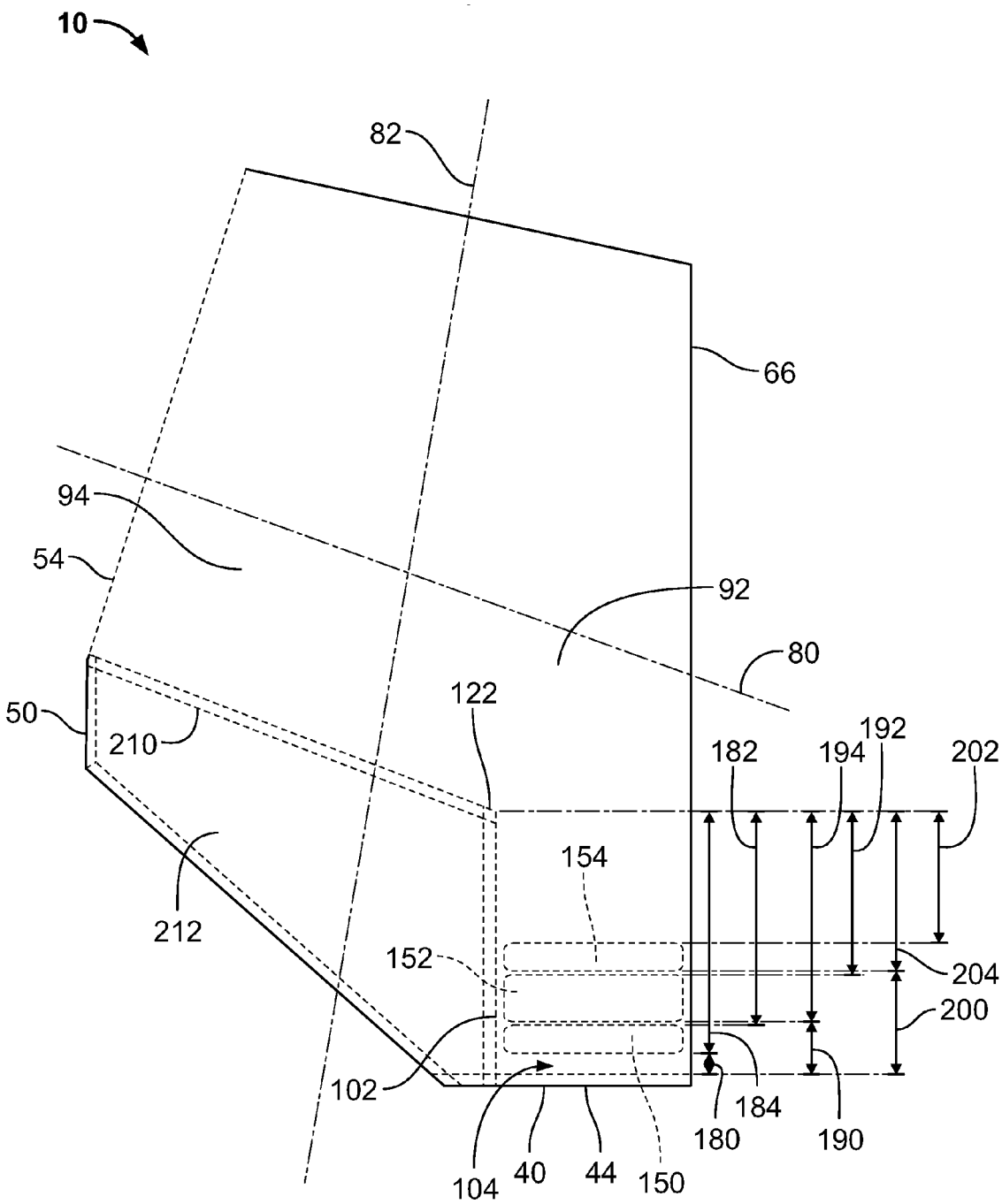
FIG. 4 is a front plan view of an exemplary embodiment of a sewn garment pocket.
Figure 5A:
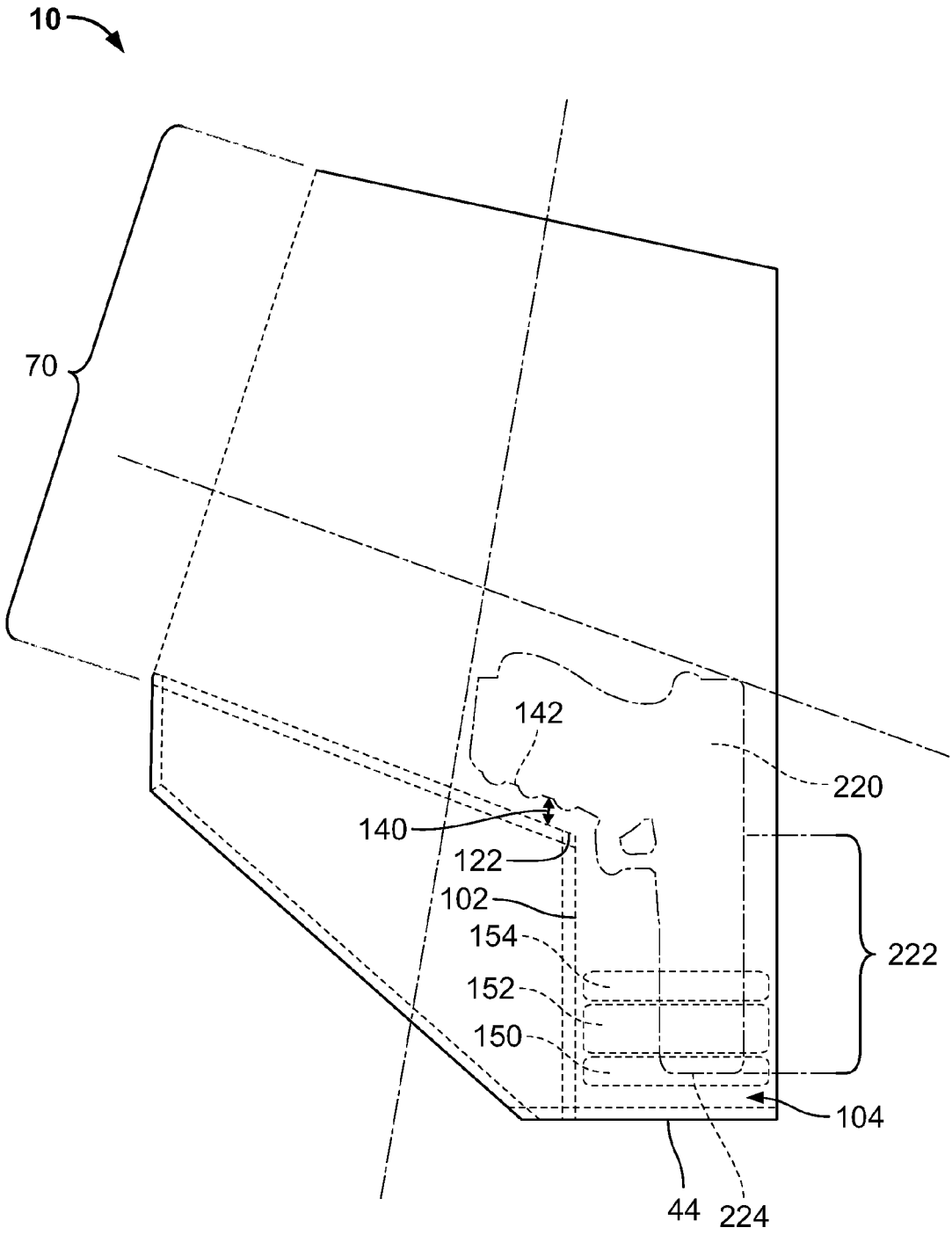
FIG. 5A is a front plan view of an exemplary embodiment of a sewn garment pocket showing a handgun being carried having a long barrel portion.

As shown in FIG. 4, the proximity of first receiving-zone sub-region 150 to first segment 40 is quantifiable by measuring a length 180, which represents the distance between first receiving-zone sub-region 150 and base edge 44. A barrel-portion range of first receiving-zone sub-region 150 is quantifiable by measuring a length 182, which represents the lower end of the range, and by measuring a length 184, which represents the upper end of the range. Referring to FIG. 5A, the barrel-portion range of first receiving-zone sub-region 150 and the proximity of first receiving-zone sub-region 150 to first segment 40 are selected such that at least one condition can be satisfied when a handgun 220 having a barrel portion 222 (which is shorter than the long barrel portion 110 of handgun 120 shown in FIG. 2) is carried in pocket 10. Specifically, muzzle 224 of handgun 220 can be present in first receiving-zone sub-region 150, i.e., barrel portion 232 terminates in first receiving-zone sub-region 150. In another embodiment, the following optional condition can be satisfied when finger gap 140 is present between grip 142 and first end 122 of first seam 102.

Figure 5B:
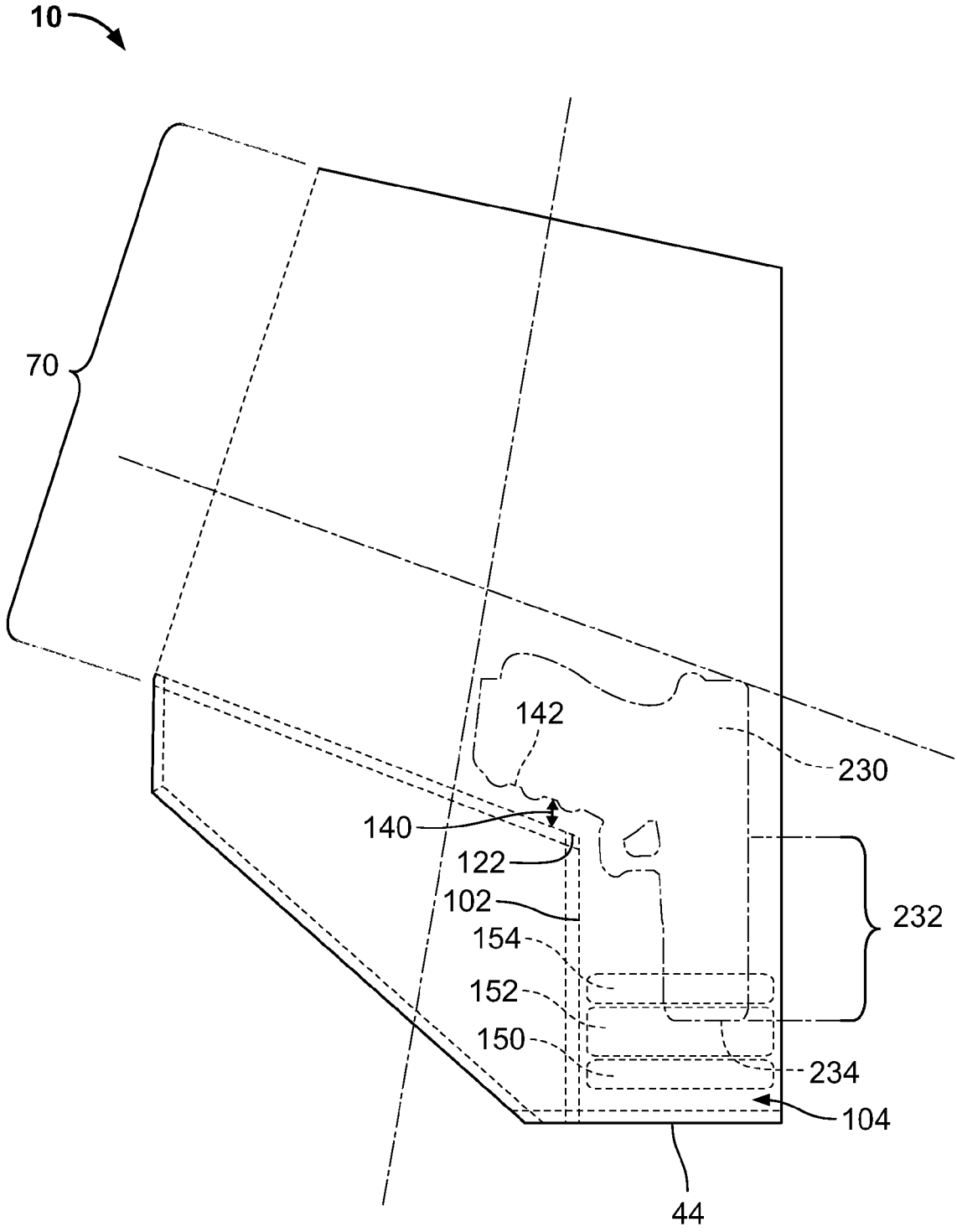
FIG. 5B is a front plan view of an exemplary embodiment of a sewn garment pocket showing a handgun being carried having a medium-length barrel portion.

Similarly, as shown in FIG. 4, the proximity of second receiving-zone sub-region 152 to first segment 40 is quantifiable by measuring a length 190, which represents the distance between second receiving-zone sub-region 152 and base edge 44. A barrel-portion range of second receiving-zone sub-region 152 is quantifiable by measuring a length 192, which represents the lower end of the range, and by measuring a length 194, which represents the upper end of the range. Referring to FIG. 5B, the barrel-portion range of second receiving-zone sub-region 152 and the proximity of second receiving-zone sub-region 152 to first segment 40 are selected such that at least one condition is satisfied when a handgun 230 having a medium-length barrel portion 232 (which is shorter than the barrel portion 222 of handgun 220 shown in FIG. 5A) is carried in pocket 10. Specifically, muzzle 234 of handgun 230 can be present in second receiving-zone sub-region 152, i.e., medium-length barrel portion 232 terminates in second receiving-zone sub-region 152. In another embodiment, the following optional condition can be satisfied when finger gap 140 is present between grip 142 and first end 122 of first seam 102.

Figure 5C:
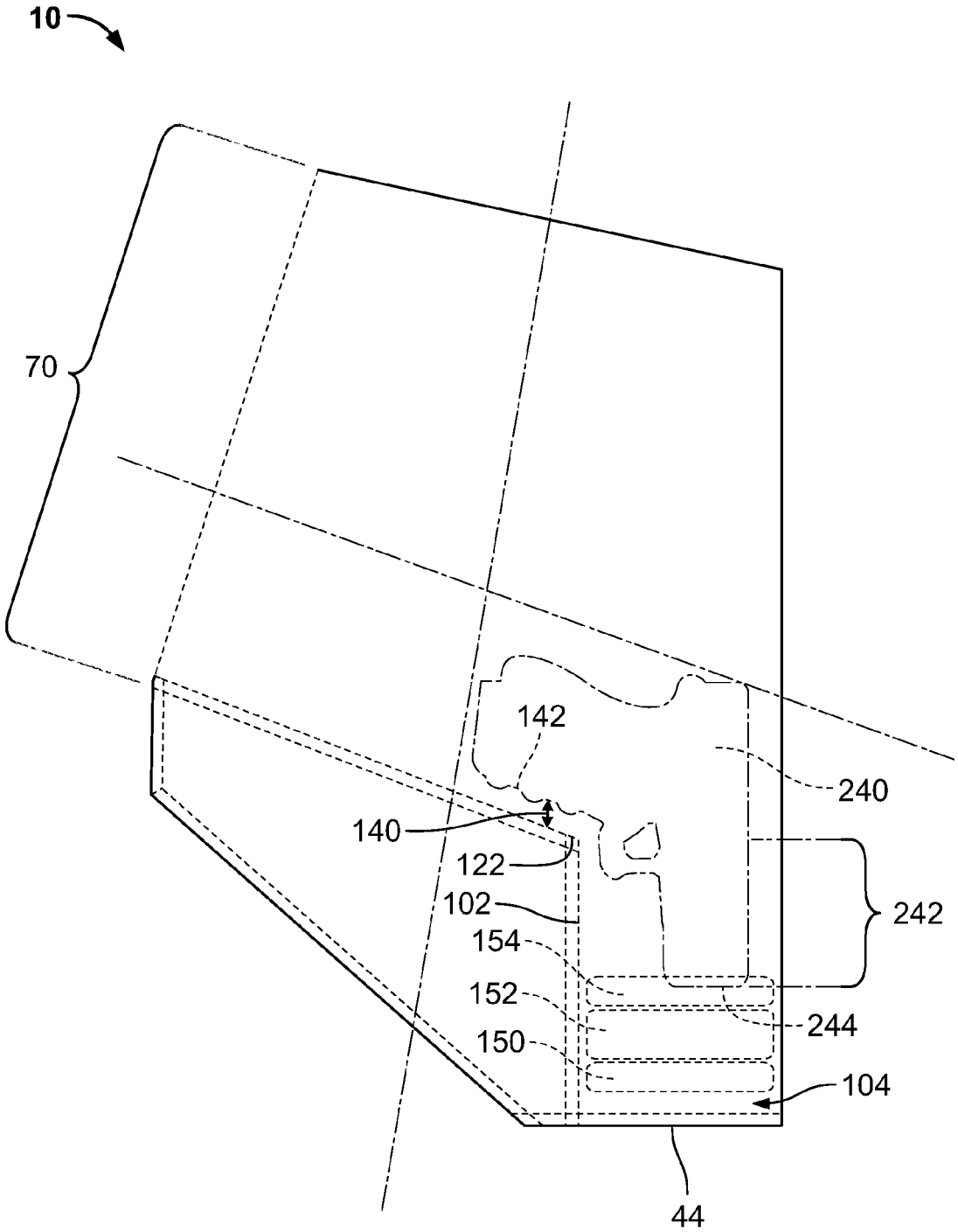
FIG. 5C is a front plan view of an exemplary embodiment of a sewn garment pocket showing a handgun being carried having a short barrel portion.

Referring to FIG. 4, the proximity of third receiving-zone sub-region 154 to first segment 40 is quantifiable by measuring a length 200, which represents the distance between third receiving-zone sub-region 154 and base edge 44. A barrel-portion range of third receiving-zone sub-region 154 is quantifiable by measuring a length 202, which represents the lower end of the range, and by measuring a length 204, which represents the upper end of the range. Referring to FIG. 5C, the barrel-portion range of third receiving-zone sub-region 154 and the proximity of third receiving-zone sub-region 154 to first segment 40 are selected such that at least one condition can be satisfied when a handgun 240 having a relatively short barrel portion 242 (which is shorter than the medium-length barrel portion 232 of handgun 230 shown in FIG. 5B) is carried in pocket 10. Specifically, muzzle 244 of handgun 240 can be present in third receiving-zone sub-region 154, i.e., relatively short barrel portion 242 terminates in third receiving-zone sub-region 154. In another embodiment, the following optional condition can be satisfied when finger gap 140 is present between grip 142 and first end 122 of first seam 102.

Referring to FIG. 4, pocket 10 also includes second seam 210, which meets first end 122 of first seam 102 and segment 50 of outer edge 54. Second seam 210 can be provided to seal off adjoining zone 212, which includes part of second region 92 and part of third region 94. Second seam 210 can be configured to aid the wearer in correctly inserting a barrel portion of a handgun into receiving zone 104 by preventing the wearer from mistakenly inserting the barrel portion into adjoining zone 212.

Figure 6:
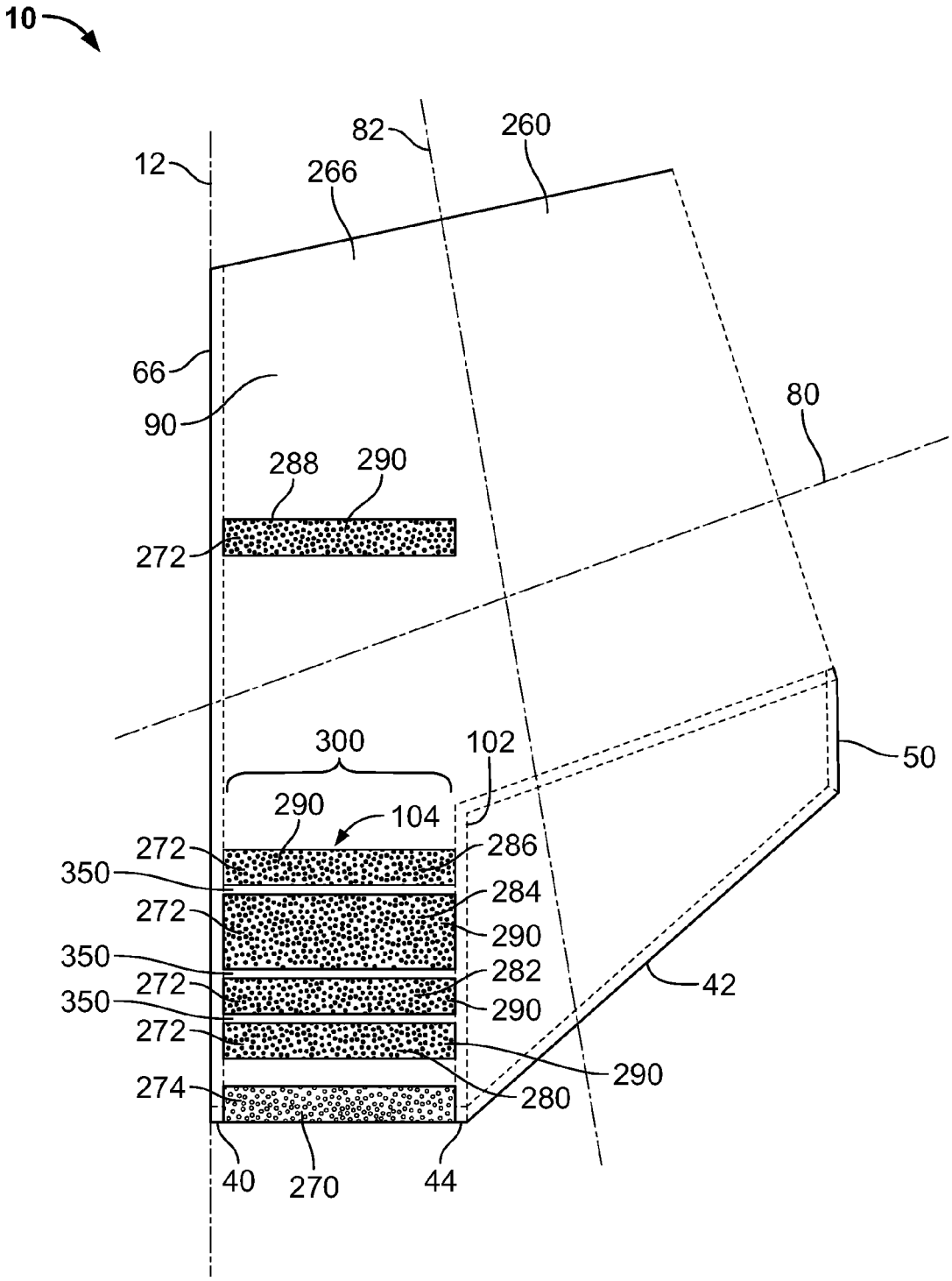
FIG. 6 is a rear plan view of an exemplary embodiment of a sewn garment pocket of the present invention.

The muzzles of the handguns shown in FIGS. 5A-5C, unlike muzzle 112 of handgun 120 shown in FIG. 2, do not contact base edge 44 because their barrel portions are shorter. Absent contact with base edge 44, a handgun is generally not properly supported within pocket 10 and, consequently, may not be carried in an ergonomic orientation. Referring to FIG. 6, exterior surface 266 of pocket 10 includes a combination of features that allow a user to readily and reversibly modify, length 132 (see FIG. 2) of receiving zone 104, to allow pocket 10 to properly carry, for example, a handgun having a barrel portion that is shorter than barrel portion 110 of handgun 120. More specifically, exterior surface 266 includes a base retaining device 270 and a plurality of corresponding retaining devices 272. As shown in FIG. 6, base retaining device 270, which in this exemplary embodiment includes hook-type fasteners 274, is adjacent, or otherwise proximate to, first segment 40 of base edge 44 and overlies, at least in part, receiving zone 104. Plurality of corresponding retaining devices 272 can include a first corresponding retaining device 280, a second corresponding retaining device 282, a third corresponding retaining device 284, a fourth corresponding retaining device 286, and a fifth corresponding retaining device 288. Each of these corresponding retaining devices 272 in this exemplary embodiment includes loop-type fasteners 290. In an alternate embodiment, base retaining device 270 includes loop-type fasteners, and plurality of corresponding retaining devices 272 include hook-type fasteners 274. Hook and loop-type fastener systems marketed under the trademark Velcro® are among those that are suitable for use in this invention. Other readily-releasable fastener systems, including (without limitation) snaps or adhesives or buttons and holes, may be used instead of, or in combination with, hook and loop-type fastener systems. Base retaining device 270 and plurality of corresponding retaining devices 272 are fastened (e.g., seamed or sewn) to inner part 260.

In the exemplary embodiment shown in FIG. 6, which shows a rear view of pocket 10, a plurality of corresponding retaining devices 272 are positioned on exterior surface 266 in a series that varies in distance from first segment 40 of base edge 44 and, hence, from base retaining device 270. First corresponding retaining device 280, which is positioned between base retaining device 270 and second corresponding retaining device 282, overlies a first portion of receiving zone 104. Second corresponding retaining device 282, which is positioned between first corresponding retaining device 280 and third corresponding retaining device 284, overlies a second portion of receiving zone 104. Third corresponding retaining device 284, which is positioned between second corresponding retaining device 282 and fourth corresponding retaining device 286, overlies a third portion of receiving zone 104. Fourth corresponding retaining device 286, which is positioned between third corresponding retaining device 284 and fifth corresponding retaining device 288, overlies a fourth portion of receiving zone 104. Fifth corresponding retaining device 288 can be positioned proximal to inner edge 66 and overlie a portion of first region 90 that is located at a distance from receiving zone opening 300 corresponding to the length of receiving zone 132.

Figure 7A:
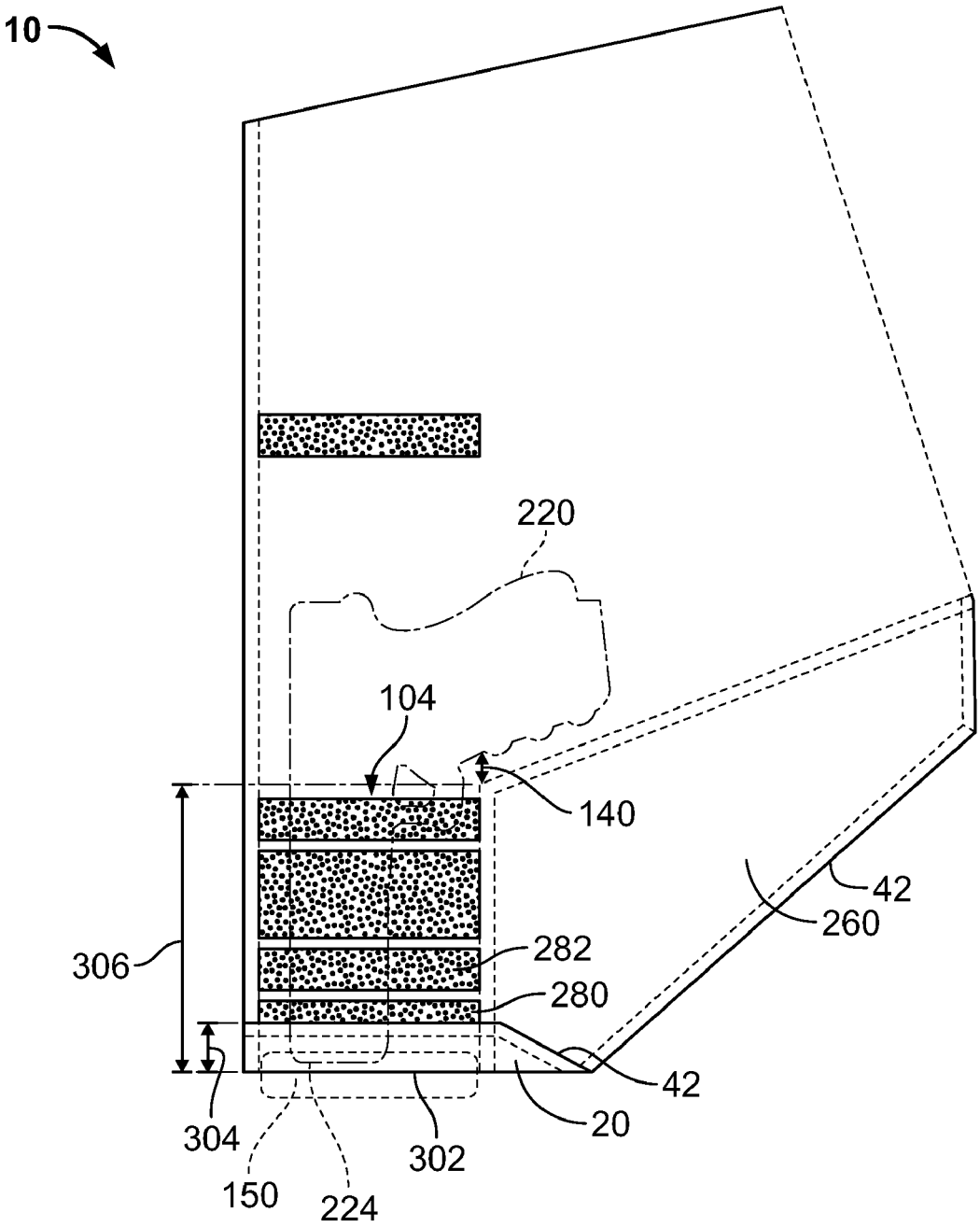
FIG. 7A is a rear plan view of an exemplary embodiment of a sewn garment pocket in a folded configuration showing a handgun having a long barrel portion being carried therein.
Figure 7B:
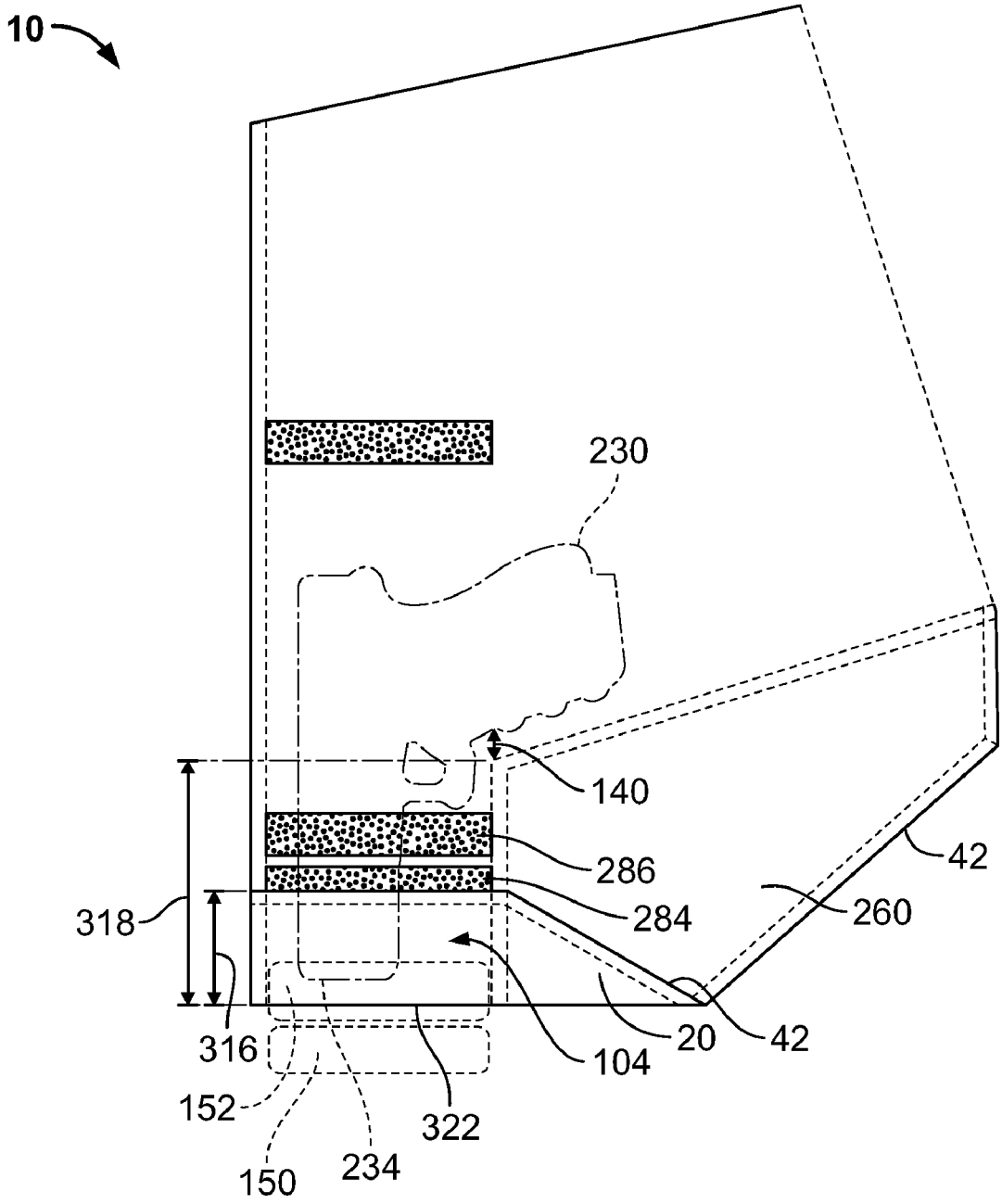
FIG. 7B is a rear plan view of an exemplary embodiment of a sewn garment pocket in another folded configuration showing a handgun having a medium-length barrel portion being carried therein.
Figure 7C:
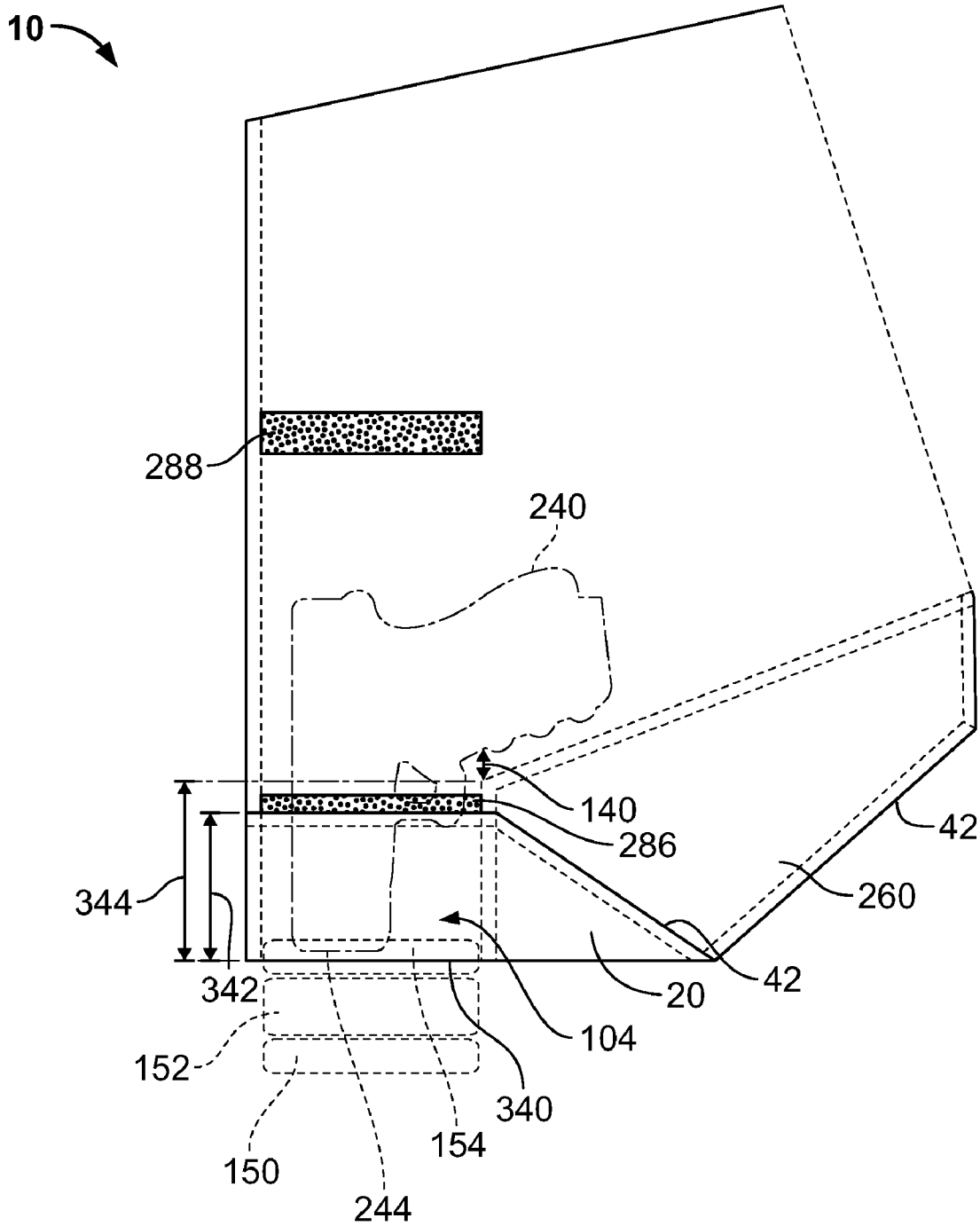
FIG. 7C is a rear plan view of an exemplary embodiment of a sewn garment pocket in still another folded configuration showing a handgun having a relatively short barrel portion being carried therein.

FIGS. 7A-7C show how the foregoing combination of features allows a wearer of pocket 10 to properly carry therein handguns having a shorter barrel portion than handgun 120 (see FIG. 2), without having to physically shorten first seam 102 or inner edge 66. As shown in FIG. 7A, base retaining device 270 (see FIG. 6) can be fastened to first corresponding retaining device 280 by folding pocket 10 such that base retaining device 270 mates with first corresponding retaining device 280. The formation of fold 302 can decrease the length of receiving zone 104 by a length 304, yielding an operative receiving zone length 306 and corresponding accessible area of receiving zone 104. When pocket 10 is in the configuration shown in FIG. 7A, handgun 220 (see also FIG. 5A) is carried in pocket 10 in an ergonomic orientation. Muzzle 224 (see also FIG. 5A) contacts and is supported by fold 302, which overlies first receiving-zone sub-region 150 (see also FIG. 5A). Finger gap 140 is present. In another example, which is shown in FIG. 7B, base retaining device 270 (see FIG. 6) can be fastened to third corresponding retaining device 284 by folding pocket 10 such that base retaining device 270 mates with third corresponding retaining device 284. The formation of fold 322 can decrease the length of receiving zone 104 by a length 316, yielding an operative receiving zone length 318. When pocket 10 is in the configuration shown in FIG. 7B, handgun 230 (see also FIG. 5B) is carried in pocket 10 in an ergonomic orientation. Muzzle 234 (see also FIG. 5B) contacts and is supported by fold 322, which overlies second receiving-zone sub-region 152 (see also FIG. 5B). Again, finger gap 140 is present. In still another example, which is shown in FIG. 7C, base retaining device 270 (see FIG. 6) can be fastened to fourth corresponding retaining device 286 by folding pocket 10 such that base retaining device 270 mates with fourth corresponding retaining device 286. The formation of fold 340 can decrease the length of receiving zone 104 by a length 342, yielding an operative receiving zone length 344. When pocket 10 is in the configuration shown in FIG. 7C, handgun 240 (see also FIG. 5C) is carried in pocket 10 in an ergonomic orientation. Muzzle 244 (see also FIG. 5C) contacts and is supported by fold 340, which overlies third receiving-zone sub-region 154 (see also FIG. 5C). Again, finger gap 140 is present.

As shown in FIGS. 6 and 7A-7C, pocket 10 includes a plurality of corresponding retaining devices 272. Gaps 350 (see FIG. 6) between each of corresponding retaining devices 280, 282, 284, 286 serve as lines along which the wearer can fold pocket 10 relatively easily when changing configurations. Additionally, telegraphing of pocket 10 is reduced when a fold coincides with a gap 350, relative to when a fold does not coincide with a gap 350, because fewer layers of material are present along the fold, thereby resulting in a fold having a reduced profile. In an alternate embodiment, a single, relatively large corresponding retaining device could be used in place of first, second, third and fourth retaining devices 280, 282, 284, 286. This embodiment may cost less to manufacture; however, it would not benefit from the advantage described above. In another alternate embodiment, base retaining device 270 and plurality of corresponding retaining devices 272 are disposed on exterior surface 354 of outer part 20 (see FIG. 2), instead of on exterior surface 266 of inner part 260 (see FIG. 6). Also, in still another alternate embodiment, plurality of corresponding retaining devices 272 can include fewer than five, or greater than five, corresponding retaining devices. For example, second corresponding retaining device 282 (see FIG. 6) can be omitted in an alternate embodiment.

Figure 8A:
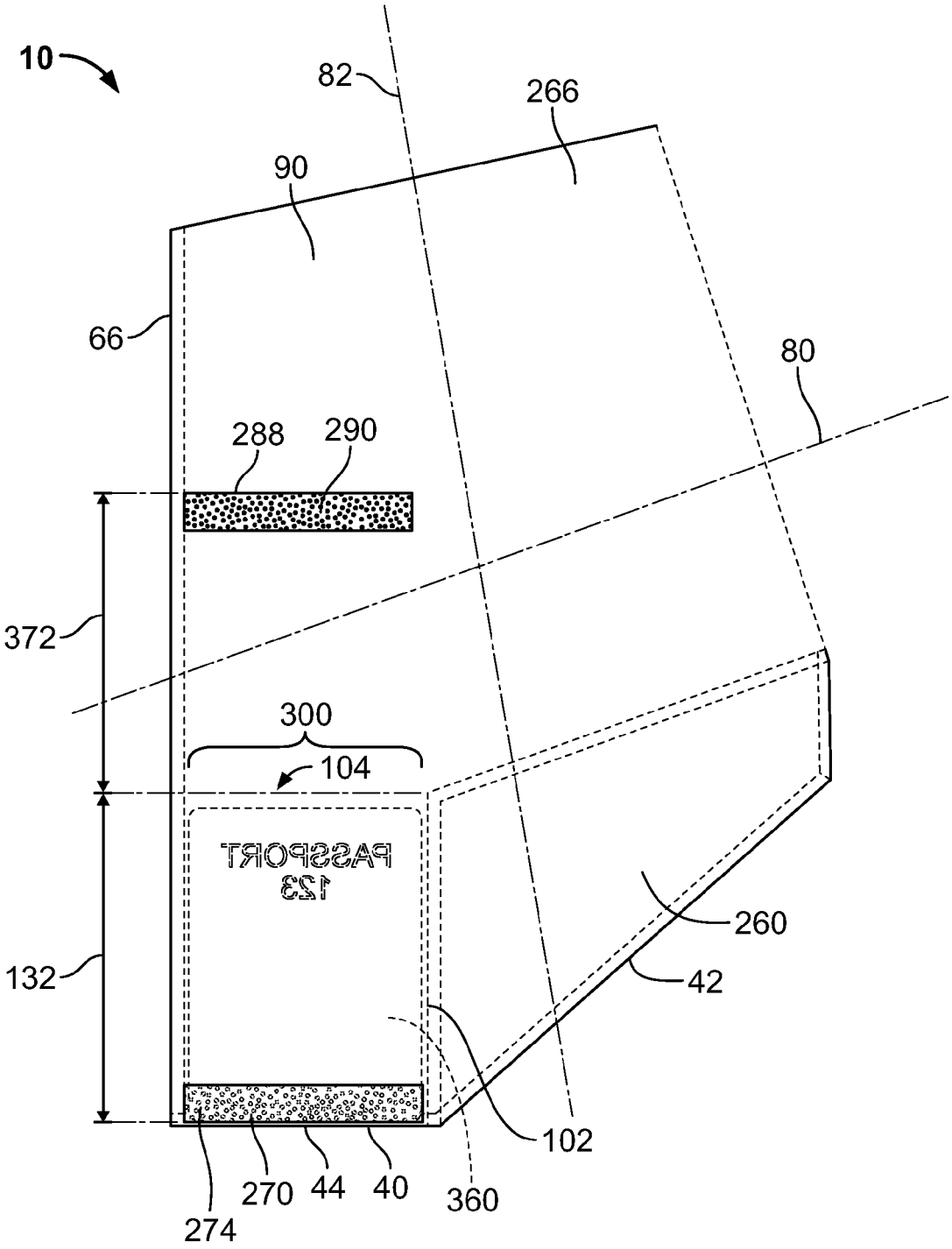
FIG. 8A is a rear plan view of an exemplary embodiment of a sewn garment pocket showing a passport being carried therein.
Figure 8B:
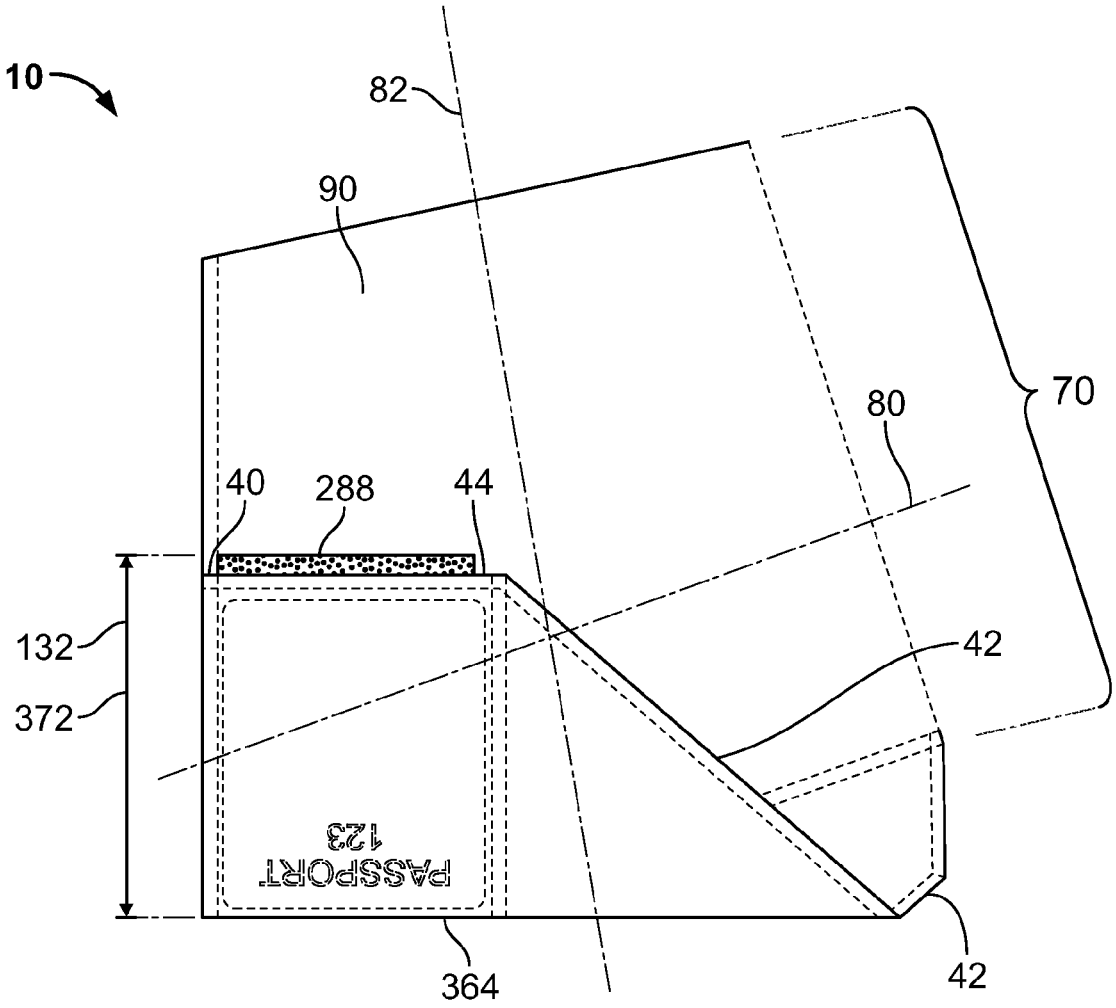
FIG. 8B is a rear plan view of an exemplary embodiment of a sewn garment pocket in still another folded configuration showing a passport being carried therein.

FIGS. 8A and 8B show how the foregoing combination of features allows a wearer of pocket 10 to carry relatively small items (e.g., passport, wallet, keys, jewelry) therein. FIG. 8A, which is a rear view of pocket 10, shows a passport 360 being carried therein, within receiving zone 104. To facilitate comprehension of FIG. 8A, first, second, third and fourth corresponding retainer devices 280, 282, 284, 286 are not shown. As depicted in FIG. 8B, base retaining device 270 (see FIG. 6) can be fastened to fifth corresponding retaining device 288 by folding pocket 10 such that base retaining device 270 mates with first corresponding retaining device 288. The presence of a fold 364 provides support for passport 360, which is enclosed within receiving zone 104 by fold 364, inner edge 40 of base edge 44, inner edge 66, and first seam 102. An individual reaching his hand into pocket 10, when in the conformation shown in FIG. 8B, likely would not readily detect the presence of passport 360. As stated previously in reference to FIG. 6, fifth corresponding retaining device 288 is proximal to inner edge 66 and overlies a portion of first region 90 that is located a distance from receiving zone opening 300 corresponding to length 132 of receiving zone 104. Thus, length 372 is approximately equal to a length 132. When pocket 10 is folded along fold 364 to mate base retaining device 270 (see FIG. 6) and fifth corresponding retaining device 288, receiving zone opening 300 is substantially flush with fold 364. Thus, an individual searching the wearer by reaching his hand into pocket 10 by way of pocket opening 70, when in the configuration shown in FIG. 8B, likely would not readily detect the presence of either receiving zone 104 or receiving zone opening 300. Pocket 10, when used in this configuration to carry a small item (e.g., passport, wallet, keys, jewelry), reduces the risk that the small item will be lost.

FIG. 9 is a partial front view of a pair of pants 380 having pocket 10 incorporated therein. Specifically, pocket 10 has been substituted for the right front pocket of pants 380. For purposes of comparison, FIG. 9 includes an approximate outline of a conventional left front pocket 382. As suggested by FIG. 9, even a relatively large conventional front pocket, such as left front pocket 382, does not allow for a handgun (or other object) to be carried in first region 90*a* or second region 92*a*, which are the respective counterparts to first region 90 and second region 92 of pocket 10, because pocket 382 does not extend into first region 90*a* and/or second region 92*a*. Telegraphing of a handgun (or other object) carried in conventional left front pocket 382 is more likely because, inter alia, the handgun (or other object) would not be retained in first region 90*a* or second region 92*a* where the handgun can be more easily concealed. Instead, the handgun would be retained in third region 94*a*, which is the counterpart to third region 94 of pocket 10. In further contrast to pocket 10, conventional left front pocket 382 does not include any features for maintaining a handgun (or other object) in a position and in an orientation that facilitates removal by the wearer.

Figure 10:
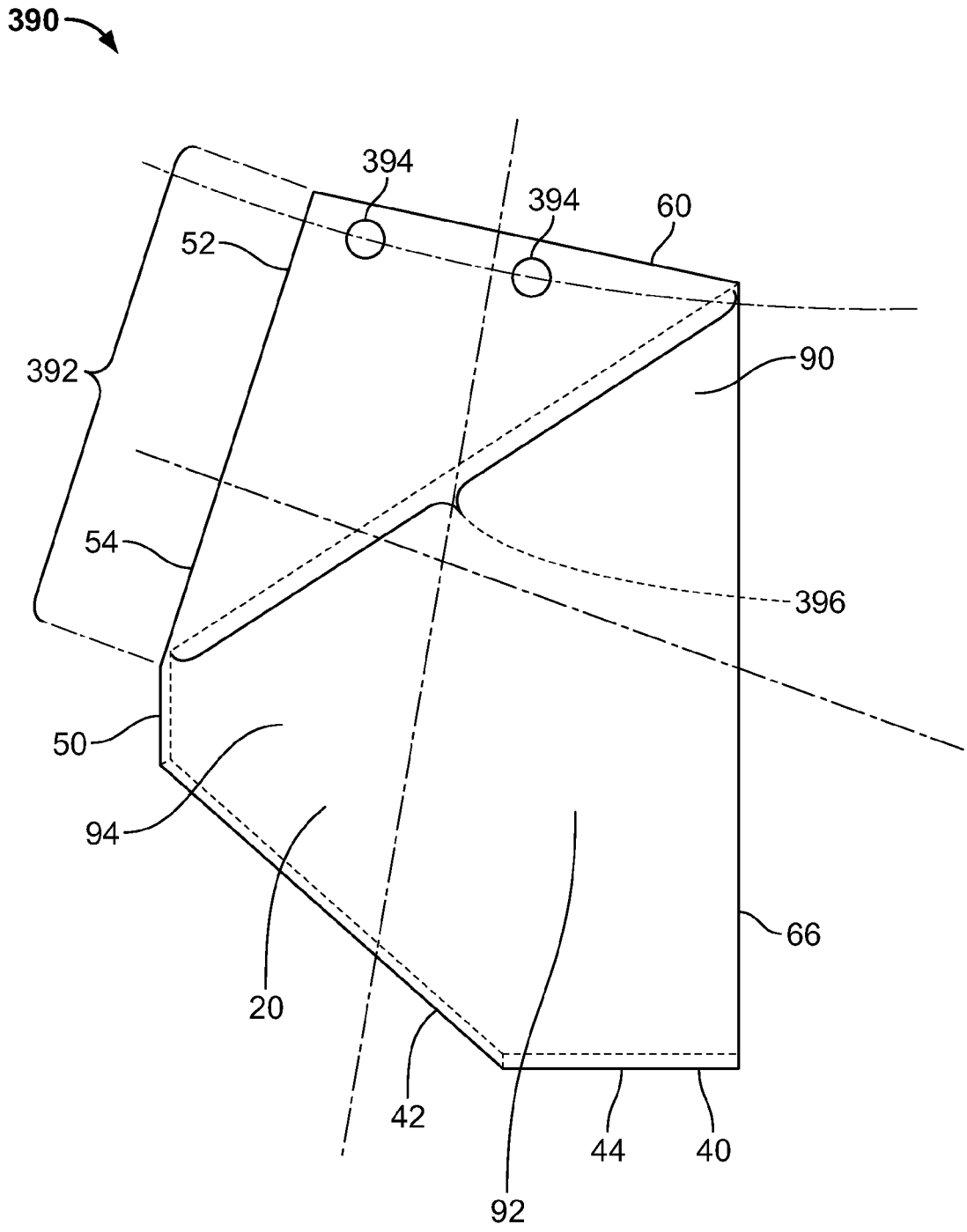
FIG. 10 is a schematic front plan view of another exemplary embodiment of the garment pocket of the present invention.

FIG. 10 is a schematic front plan view of another exemplary embodiment of the garment pocket of the present invention. Pocket 390, which is shown configured for access by a wearer's right hand, is intended for incorporation into a garment (e.g., pants, shorts, skirts). In an alternate embodiment, pocket 390 can be configured for access by a wearer's left hand. Only outer part 20 is shown in FIG. 10 because outer part 20 and the corresponding inner part are substantially congruent. Outer part 20 and the corresponding inner part may be formed from a single piece of pliable material. Outer part 20 can be fastened (e.g., seamed or sewn) to the corresponding inner part at least along (1) first segment 40 and second segment 42 of base edge 44, and (2) segment 50 of outer edge 54. In contrast to pocket 10, outer part 20 of pocket 390 is not fastened to the inner part along top edge 60. Alternatively, outer part 20 and the corresponding inner part may be derived from two or more pieces of pliable material. In such instances, outer part 20 is additionally fastened to the corresponding inner part along inner edge 66.

In pocket 390, the corresponding inner part (but not outer part 20) can be fastened to the waistline of the garment along top edge 60. Similarly, the corresponding inner part (but not outer part 20) is intended to be fastened to the garment along segment 52 of outer edge 54, which coincides with unenlarged pocket opening 392 (explained below). Both outer part 20 and the corresponding inner part are intended to be fastened to the garment along segment 50 of outer edge 54. Outer edge 54 can be used to maintain pocket 10 in a proper position following incorporation into the garment, especially as pocket 390 generally is not fastened to the garment along inner edge 66 or base edge 44. Additionally, in pocket 390, outer part 20 is releasably fastened to the corresponding inner part along top edge 60 via readily-releasable fasteners 394 that are disguised or hidden within a flap in the garment that also serves as a waistband. As shown in FIG. 10, readily-releasable fasteners 394 are snaps; however, other readily-releasable fasteners, including (without limitation) hook and loop-type fasteners (e.g., Velcro®) may be used instead of, or in combination with, snaps. In another embodiment, outer part 20 can alternatively be releasably fastened to the corresponding inner layer along outer edge 54.

Pocket 390 is shown with an unenlarged pocket opening 392, which is comparable in size to a conventional pocket opening. The wearer can freely insert his hand into pocket 390 by way of unenlarged pocket opening 392 and grip an exemplary object (e.g., handgun, passport) carried therein in receiving zone 104. However, removal of the exemplary object from pocket 390 by way of unenlarged pocket opening 392 can be impeded because the size of the wearer's hand, when gripping the exemplary object, is greater than the size of the unenlarged pocket opening. Upon the release of readily-releasable fasteners 394, the opening of pocket 10 becomes enlarged pocket opening 396. Enlarged pocket opening 396 is significantly larger than unenlarged pocket opening 392. Enlarged pocket opening 396 is dimensioned such that the wearer can readily remove the exemplary object from pocket 390 because the size of enlarged pocket opening 396 is significantly greater than the size of the wearer's hand gripping the exemplary object. Aside from the presence of enlarged pocket opening 396 and the attendant modifications, pocket 390 is otherwise similar to pocket 10.

Figure 11:
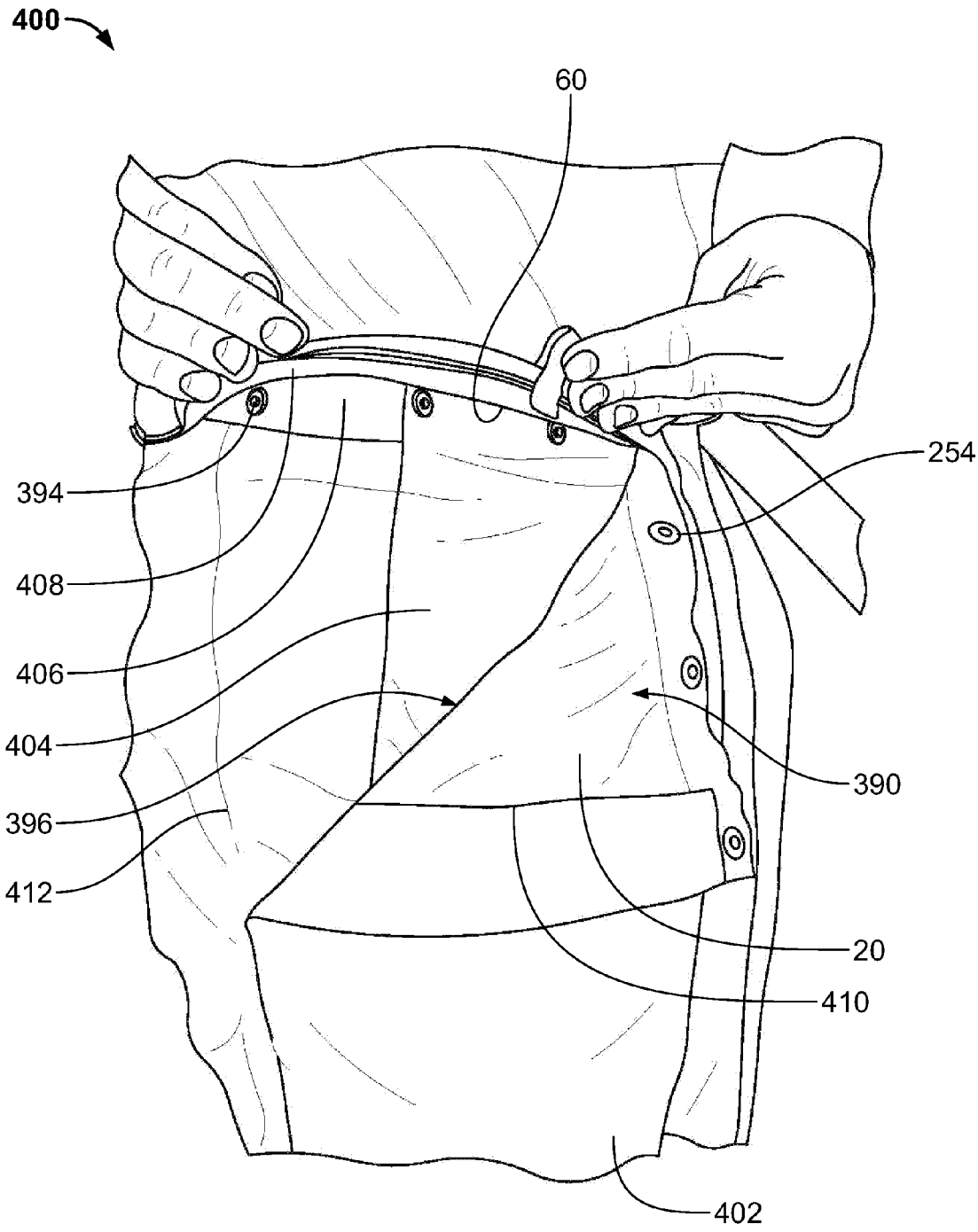
FIG. 11 is a side view of a wearer wearing pants having an exemplary embodiment of the garment pocket incorporated therein.

FIG. 11 is a side view of wearer 400 wearing pants 402 having pocket 390 incorporated therein. The opening of pocket 390 is shown in its enlarged state, i.e., enlarged pocket opening 396, as readily-releasable fasteners 394 are not fastened. As stated earlier, enlarged pocket opening 396 is dimensioned such that wearer 400 can readily remove an exemplary object (e.g., handgun, passport) from pocket 390. FIG. 11 also shows the relationship between inner layer 404 and outer part 20. The pre-existing seams of pants 402 can be used when incorporating pocket 390, to minimize the possibility that an observer will notice that pants 402 have been modified. For example, top edge 60 of inner layer 404 is fastened (e.g., seamed) along waistline 406 of pants 402, beneath beltline 408. When fastened, fasteners 394 are concealed by beltline 408, hiding the presence of a pocket opening that is enlargeable (see enlarged pocket opening 396). Additionally, there is no requirement that inner layer 404 and outer part 20 be congruent. As shown in FIG. 11, side edge 410 of outer part 20 extends further toward side seam 412 of pants 402 than does inner layer 404.

Figure 12A:
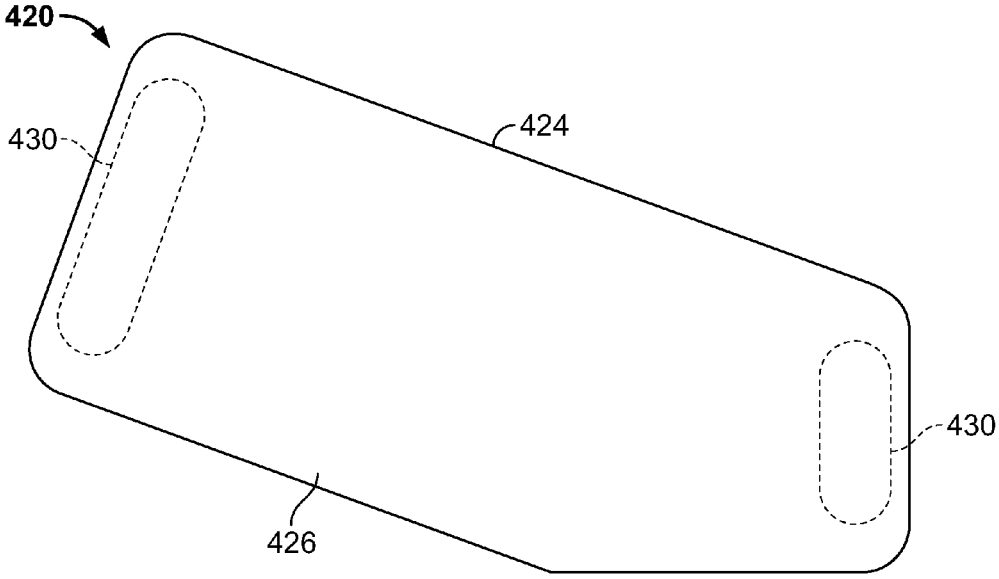
FIG. 12A is a top view of an exemplary embodiment of an anti-telegraphing device.
Figure 12B:
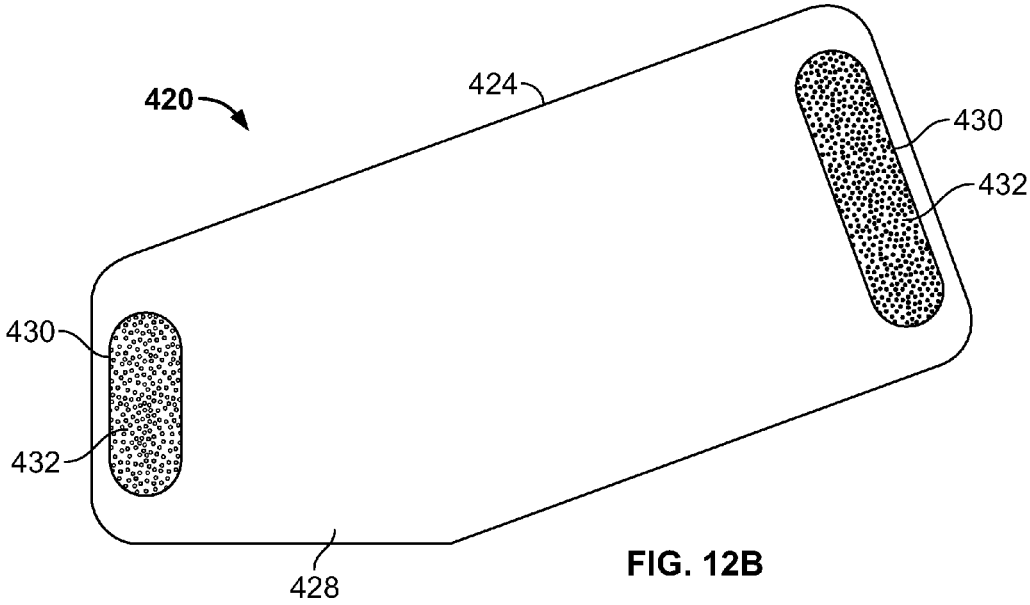
FIG. 12B is a bottom view of the anti-telegraphing device shown in FIG. 12A.
Figure 12C:
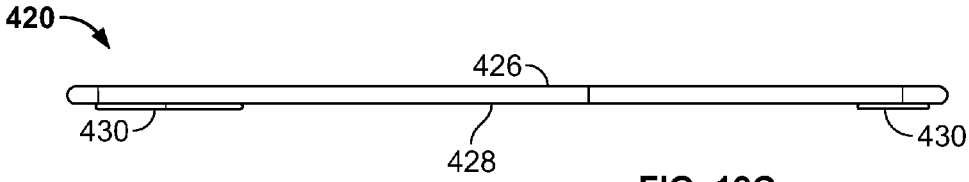
FIG. 12C is a side view of the anti-telegraphing device shown in FIG. 12A.

FIGS. 12A-12C and FIG. 13 show an anti-telegraphing device 420, and the attendant features of pocket 10 that aid the wearer in using anti-telegraphing device 420. FIGS. 12A and 12B are top and bottom views, respectively, of anti-telegraphing device 420, which includes a sheet of flexible material 424 having a first major surface 426 and an opposing second major surface 428. Exemplary flexible materials include resilient polymeric materials (e.g., ultra-high molecular weight polyethylene). Second major surface includes one or more retaining devices 430, which in this exemplary embodiment includes hook-type fasteners 432. Retaining devices 430 are positioned and oriented on second major surface 428 to allow the wearer to fasten anti-telegraphing device 420 to pocket 10 by way of corresponding retaining devices 440 (see FIG. 3) included on exterior surface 354 of outer part 20. As shown in FIG. 3, corresponding retaining devices 440 include loop-type fasteners 442, which are configured to mate hook-type fasteners 432 of retaining devices 430. In an alternate embodiment, retaining devices 430 include loop-type fasteners, and corresponding retaining devices 440 include hook-type fasteners 274. Other readily-releasable fastener systems, including (without limitation) snaps or adhesives, may be used instead of, or in combination with, hook and loop-type fastener systems. Retaining devices 430 are attached to sheet of flexible material 424 by adhesive or other suitable method. Preferably, corresponding retaining devices 440 are fastened (e.g., seamed or sewn) to outer part 20. FIG. 12C shows a side view of anti-telegraphing device 420.

Figure 13:
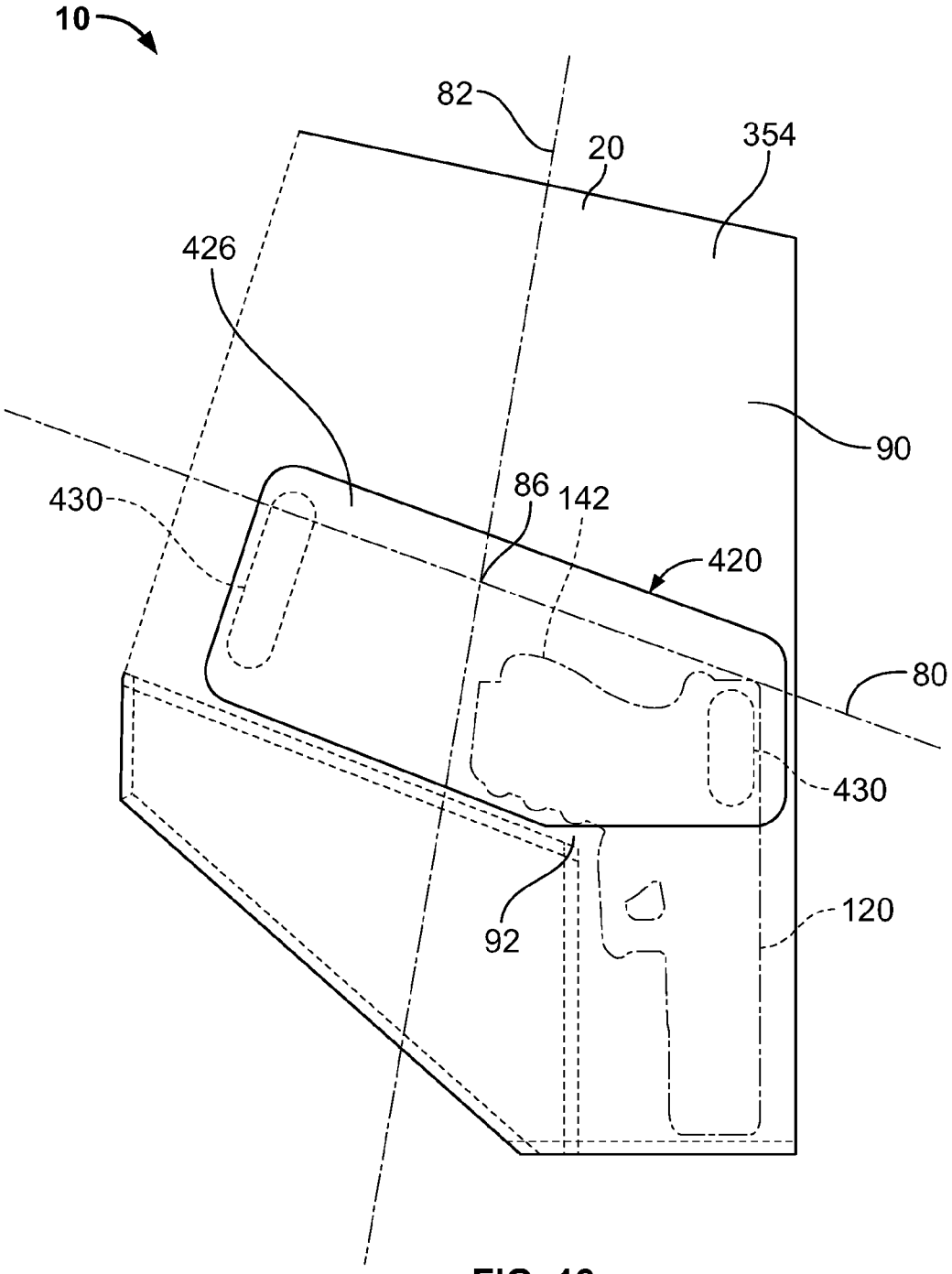
FIG. 13 is a front plan view of an exemplary embodiment of a sewn garment pocket of the present invention with an anti-telegraphing device.

FIG. 13 shows pocket 10 having anti-telegraphing device 420 deployed thereon. Anti-telegraphing device 420 (see FIG. 12C) mediates contact between exterior surface 354 of pocket 10 and the wearer's pants. Thus, some of the protrusions or other irregularities in exterior surface 354 that arise when handgun 120 is being carried in pocket 10 are translated less efficiently into visible protrusions or irregularities in the surface of the wearer's pants, thus reducing telegraphing. The smooth profile of anti-telegraphing device 420, which is suggested by FIG. 12C, aids in concealing handgun 120 by rounding out some of these protrusions and other irregularities, especially those caused by grip 142.

In an alternate embodiment, anti-telegraphing device 420 may be permanently fused to, bonded to, or sewn into exterior surface 354. In such instances, anti-telegraphing device 420 may be composed of a medium-to-heavyweight coarsely woven cotton or cotton and polyester blend, such as osnaburg. In other such instances, anti-telegraphing device 420 may be composed of non-woven support fabric. Anti-telegraphing device 420 may also take different shapes and sizes.

Figure 14A:
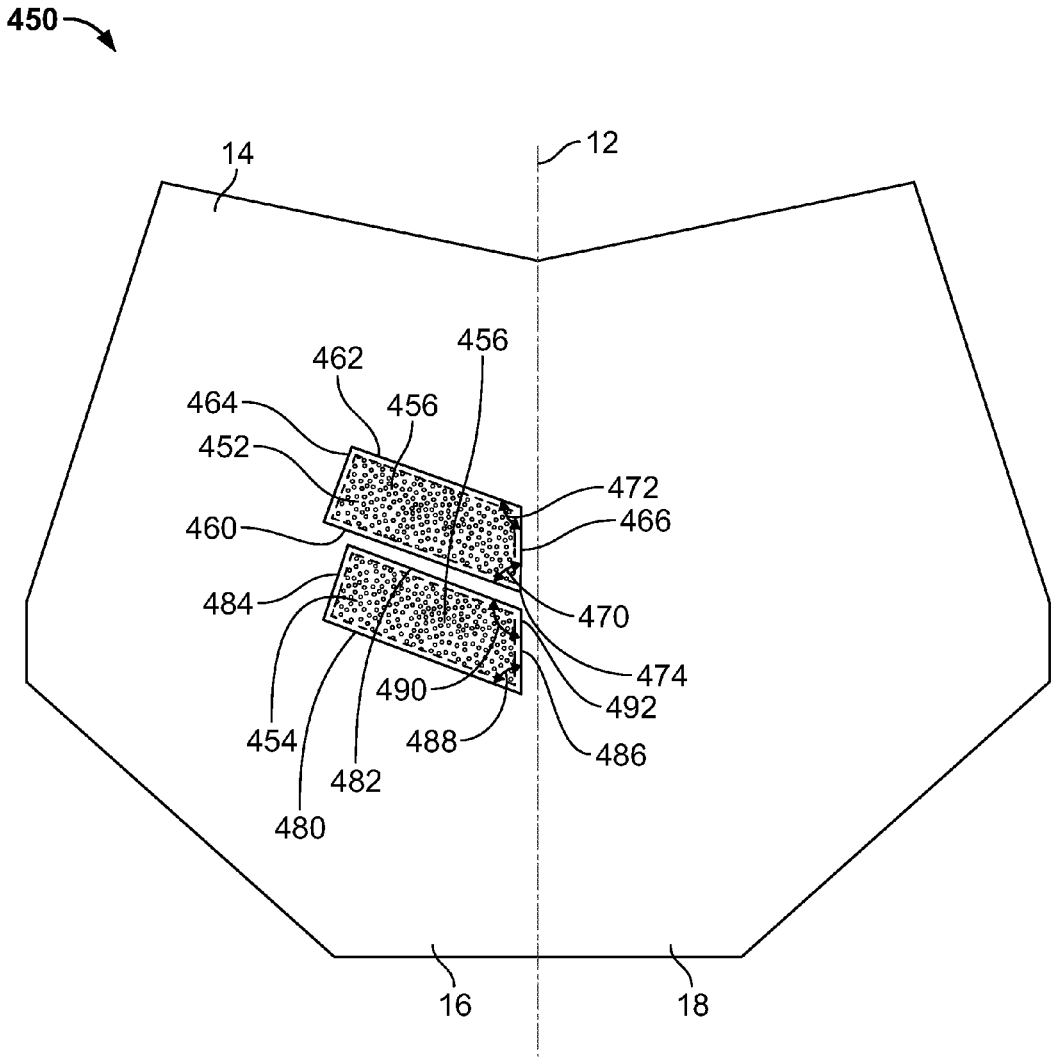
FIG. 14A is a front plan view of an unsewn exemplary embodiment of the garment pocket of the present invention.
Figure 14B:
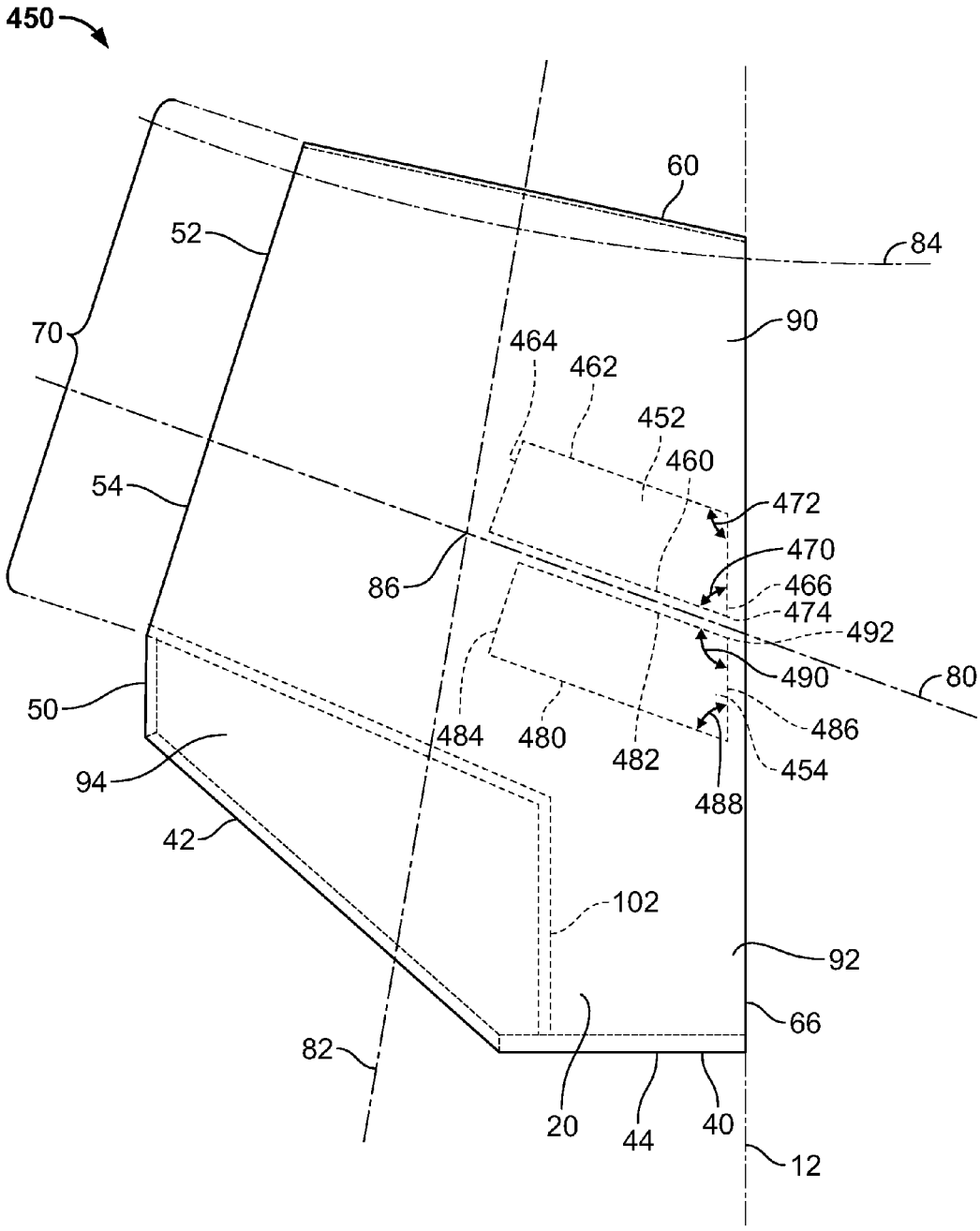
FIG. 14B is a front plan view of a sewn exemplary embodiment of the garment pocket of the present invention.

FIGS. 14A and 14B show another exemplary embodiment of the garment pocket of the present invention. Pocket 450 is substantially similar to pocket 10 but has optional features that aid the wearer in additionally carrying, in a concealed and readily-accessible state, an extra handgun magazine or other relatively small object (e.g., bullets, pepper spray, pocket tool, handcuffs, dagger, etc.). As shown in FIG. 14A, the first interior surface of pocket 450 includes a first attachment zone 452 and a second attachment zone 454. First attachment zone 452 and a retainer 510 (see FIGS. 15A, 15C, and 15D) are mutually configured to enable retainer 510 to be releasably attached, removed and reattached multiple times to the first interior surface of pocket 450. In another embodiment, first attachment zone 452 is included instead on the opposing second interior surface. As shown in FIG. 14A, first attachment zone 452 includes loop-type fasteners 456 to enable releasable attachment to retainer 510, by way of corresponding hook-type fasteners 534 on retainer 510 (see FIG. 15D). Hook and loop-type fastener systems marketed under the trademark Velcro® are among those that are suitable for use in this invention. Other readily-releasable fastener systems, including (without limitation) snaps or adhesives, may be used instead of, or in combination with, hook and loop-type fastener systems. In this exemplary embodiment, loop-type fasteners 456, as opposed to hook-type fasteners 534, are present on first attachment zone 452 because loop-type fasteners are generally less abrasive than hook-type fasteners. Thus, when pocket 450 is being used without retainer 510, the wearer may experience less discomfort from contact with loop-type fasteners 456 when inserting (or withdrawing) a hand in (or from) pocket 450. In an alternate embodiment, hook-type fasteners can be used on first attachment zone 452 and loop-type fasteners can be used on retainer 510. Alternatively, a non-hook and loop-type fastener system (e.g., snaps) may be used in first attachment zone 452 and retainer 510.

Second attachment zone 454 and retainer 510 (see FIGS. 15A-15D) are mutually configured to enable retainer 510 to be releasably attached, removed, and reattached to the first interior surface of pocket 450. The structure and function of second attachment zone 454 is similar to the structure and function of first attachment zone 452, and the variations in structure described above in relation to first attachment zone 452 are equally applicable to second attachment zone 454. In another embodiment, second attachment zone 454 is included instead on the opposing second interior surface. In the exemplary embodiment shown in FIGS. 14A and 14B, first attachment zone 452 is substantially identical in size to second attachment zone 454. However, in other embodiments, first attachment zone 452 and second attachment zone 454 may have different sizes. The exemplary embodiment shown in FIGS. 14A and 14B is configured to enable the releasable attachment of two retainers 510, each of which is configured to retain therein a handgun magazine, such as that shown in FIG. 15B, or other item. In other exemplary embodiments, pocket 450 can include one attachment zone or three or more attachment zones.

First attachment zone 452 can be located in first region 90 of pocket 450. As shown in the exemplary embodiment, first attachment zone 452 is located adjacent to line 80, which corresponds to the line of flexion corresponding to the wearer's hip joint, and adjacent to inner edge 66, which corresponds approximately to the line defined by the wearer's inseam. In other embodiments, first attachment zone 452 may be located elsewhere in first region 90, provided first attachment zone 452 does not substantially intersect line 80 or line 82. Also, as shown in FIGS. 14A and 14B, the shape of first attachment zone 452 is a right-angled trapezoid, rendering first attachment zone 452 substantially congruent to retainer 510 shown in FIGS. 15A, 15C, and 15D, thereby providing guidance to the wearer as he seeks to mate hook-type fasteners 534 of retainer 510 with loop-type fasteners 456 of first attachment zone 452 and fix retainer 510 in proper position and orientation in first region 90. In other embodiments, first attachment zone 452 and retainer 510 are not substantially congruent, but still have the requisite and respective fastening (or mating) portions to enable releasable attachment, removal and reattachment multiple times. First attachment zone 452 has two substantially parallel sides: first parallel side 460 and second parallel side 462. Additionally, first attachment zone 452 has a perpendicular side 464, which is perpendicular to first parallel side 460 and to second parallel side 462, and a non-perpendicular side 466. First parallel side 460 and non-perpendicular side 466 meet at an acute angle 470, and second parallel side 462 and non-perpendicular side 466 meet at an obtuse angle 472. First attachment zone 452 is oriented such that non-perpendicular side 466 is substantially parallel to inner edge 66, and first parallel side 460 is substantially parallel to line 80. Additionally, first attachment zone 452 is oriented such that vertex 474 of acute angle 470 is proximate to the intersection of line 80 and inner edge 66. In the exemplary embodiment, acute angle 470 is approximately seventy degrees (70°). An acute angle 470 of approximately seventy degrees (70°) aligns retainer 510, such that retainer opening 524 is directed toward pocket opening 70, thereby facilitating removal, by the wearer, of the object (e.g., handgun magazine) retained in retainer 510. Depending on the application and/or the location of first attachment zone 452 in first region 90, however, acute angle 470 may range from approximately forty-five degrees (45°) to approximately eighty-five degrees (85°) and, more preferably, from approximately sixty degrees (60°) to approximately eighty degrees (80°). Acute angle 470 may also vary with the configuration of pocket opening 70.

Second attachment zone 454 is located in second region 92 of pocket 450. As shown in the exemplary embodiment, second attachment zone 454 is located adjacent to line 80, which corresponds to the line of flexion corresponding to the wearer's hip joint, and adjacent to inner edge 66, which corresponds approximately to the line defined by the wearer's inseam. In other embodiments, second attachment zone 454 may be located elsewhere in second region 92, provided second attachment zone 454 does not substantially intersect line 80 or line 82. Also, as shown in the exemplary embodiment, the shape of second attachment zone 454 is a right-angled trapezoid, rendering second attachment zone 454 substantially congruent to first attachment zone 452 and retainer 510, thereby providing guidance to the wearer as he seeks to mate hook-type fasteners 534 of retainer 510 with loop-type fasteners 456 of second attachment zone 454 and fix retainer 510 in proper position and orientation in second region 92. In other embodiments, second attachment zone 454 and retainer 510 are not substantially congruent, but still have the requisite and respective fastening (or mating) portions to enable releasable attachment, removal and reattachment multiple times. Accordingly, second attachment zone 454 has two substantially parallel sides: first parallel side 480 and second parallel side 482. Additionally, second attachment zone 454 has a perpendicular side 484, which is perpendicular to first parallel side 480 and to second parallel side 482, and a non-perpendicular side 486. First parallel side 480 and non-perpendicular side 486 meet at an acute angle 488, and second parallel side 482 and non-perpendicular side 486 meet at an obtuse angle 490. Second attachment zone 454 is oriented such that non-perpendicular side 486 is substantially parallel to inner edge 66, and second parallel side 482 is substantially parallel to line 80. Additionally, second attachment zone 454 is oriented such that vertex 492 of obtuse angle 490 is proximate to the intersection of line 80 and inner edge 66. In other embodiments, the shapes of first and/or second attachment zones 452, 454 vary depending on the application. First and/or second attachment zones 452, 454 for use in carrying handcuffs, for example, can have a circular, semicircular, or elliptical shape. Similarly, first and/or second attachment zones 452, 454 for use in carrying a dagger, for example, can have a triangular shape. Variation in the application generally results also in an analogous change in the shape of retainer 510 (see FIGS. 15A, 15C, and 15D).

In the exemplary embodiment, obtuse angle 490 is approximately one-hundred-ten degrees (110°). An obtuse angle 490 of approximately one hundred ten degrees (110°) aligns retainer 510 such that retainer opening 526 is directed toward pocket opening 70, thereby facilitating removal by the wearer of the object (e.g., handgun magazine) retained in retainer 510. Depending on the application and/or the location of second attachment zone 454 in second region 92, however, obtuse angle 490 may range from approximately ninety-five degrees (95°) to approximately one-hundred-thirty-five degrees (135°) and, more preferably, from approximately one hundred degrees (100°) to approximately one-hundred-twenty degrees (120°). Obtuse angle 490 may also vary with the configuration of pocket opening 70. In one embodiment, acute angle 470 of first attachment zone 452 can be supplementary to obtuse angle 490 of second attachment zone 454, as shown in the exemplary embodiment. Accordingly, any retainers 510 attached respectively to first attachment zone 452 and second attachment zone 454 will be similarly oriented toward pocket opening 70.

Figure 15A:
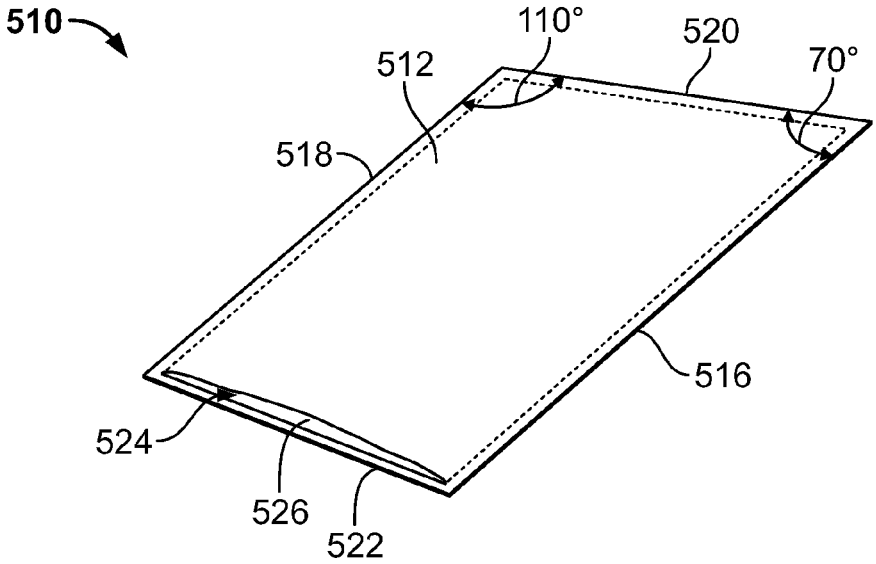
FIG. 15A is a top perspective view of a retainer for use with the garment pocket shown in FIGS. 14A and 14B.
Figure 15B:
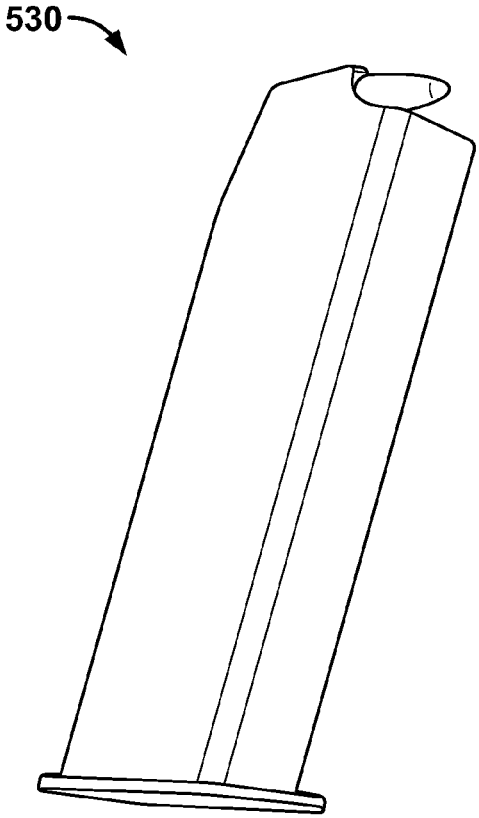
FIG. 15B is a perspective view of an exemplary handgun magazine.
Figure 15C:
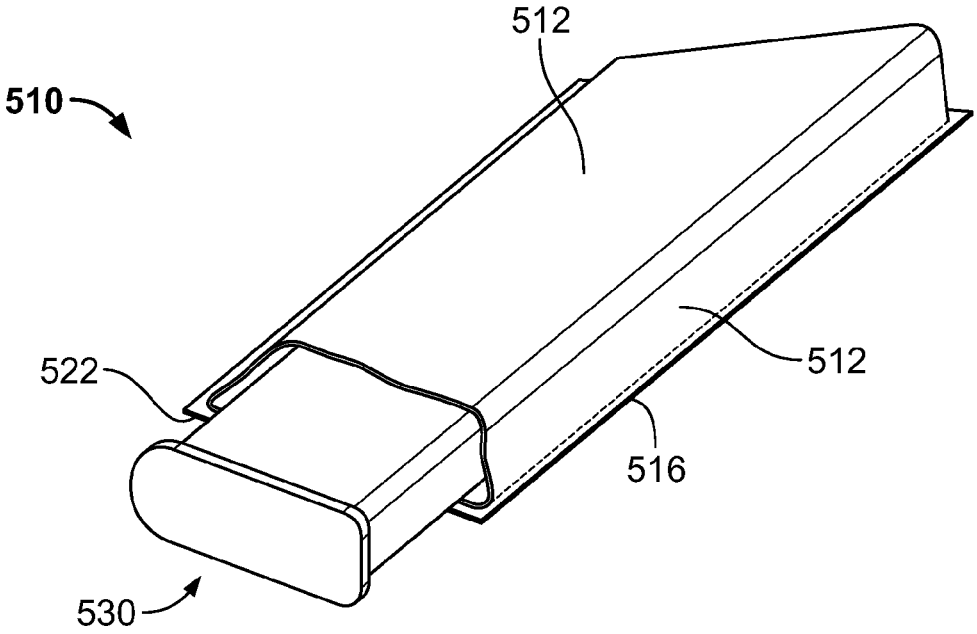
FIG. 15C is a top perspective view of the exemplary retainer shown in FIG. 15A retaining therein the exemplary handgun magazine shown in FIG. 15B.
Figure 15D:
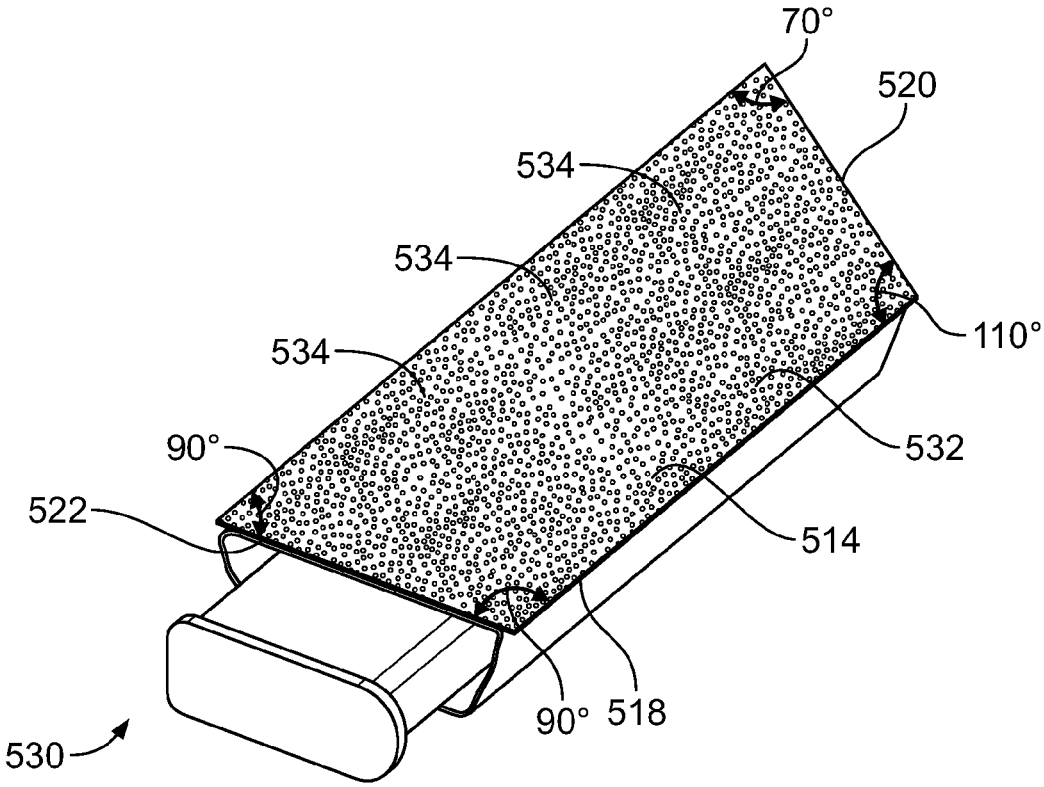
FIG. 15D is a bottom perspective view of the exemplary retainer shown in FIG. 15A retaining therein the exemplary handgun magazine shown in FIG. 15B.

FIGS. 15A-15D illustrate the structure and function of an exemplary retainer. FIG. 15A consists of a top perspective view of retainer 510 for use with the embodiment of pocket 450 shown in FIGS. 14A and 14B. More specifically, retainer 510 is suitable for attachment to either first attachment zone 452 or second attachment zone 454. Retainer 510 includes a first layer 512 and a second layer 514 (see FIG. 15D). First layer 512 is fastened (e.g., seamed or sewn) to second layer 514 along first parallel side 516 and second parallel side 518, and (optionally) along non-perpendicular side 520. First layer 512 is not fastened to second layer 514 along perpendicular side 522 in order to form a retainer opening 524 along perpendicular side 522, which provides access to a partially enclosed space 526 located between first layer 512 and second layer 514. Retainer 510 is configured to receive in partially enclosed space 526 at least a portion of a handgun magazine, for example, the exemplary nine millimeter (9 mm) handgun magazine 530 shown in FIG. 15B. First layer 512 of exemplary retainer 510 incorporates an elastic fiber (e.g., spandex, Lycra®) and, therefore, is elastic. Accordingly, as handgun magazine 530 is inserted in retainer 510 by way of retainer opening 524, first layer 512 expands in response to the contact force being exerted thereon by handgun magazine 530. Thus, the volume of partially-enclosed space 526 increases, enabling retainer 510 to retain at least a portion of handgun magazine 530 in position in partially-enclosed space 526. In an expanded state, first layer 512, which is elastic, exerts a compressive force on handgun magazine 530 to aid in retaining it in retainer 510. FIG. 15C, which is a top perspective view of handgun magazine 530 retained in retainer 510, shows first layer 512 in an expanded state. Second layer 514 is shown in FIG. 15D, which is a bottom perspective view of handgun magazine 530 retained in retainer 510. Second layer 514 includes an exterior surface 532 that includes a plurality of hook-type fasteners 534, which enable retainer 510 to be releasably attached to either first attachment zone 452 or second attachment zone 454. In another embodiment loop-type fasteners may be used on exterior surface 532, provided that hook-type fasteners are present in first attachment zone 452, second attachment zone 454, or both. Alternatively, a non-hook and loop-type fastener system (e.g., snaps, adhesives) may be used between or among retainer(s) 510, first attachment zone 452, and/or second attachment zone 454. In still other embodiments, the area of first attachment zone 452 or second attachment zone 454, respectively, can be increased (or otherwise configured) to enable the attachment of two or more retainers 510 thereto, or to provide the wearer additional options in locating and/or orienting a (single) retainer 510 within first attachment zone 452 or second attachment zone 454, respectively. In some of these embodiments and in still other embodiments, first attachment zone 452 (or second attachment zone 454) may partially extend into second region 92 (or first region 90) and/or third region 94 and/or fourth region (the remaining quadrant). In still another embodiment, first layer 512 is instead fastened (e.g., seamed or sewn) directly to either inner part (e.g., inner layer 404 (see FIG. 11)) or outer layer 20 to form the retainer or retaining device, thus eliminating second layer 514. In this embodiment, the retainer or retaining device is consequently permanently attached to the pocket and, accordingly, is not releasably attached thereto. In another embodiment, the features of pocket 450 may be combined with the features of pocket 390 (see FIGS. 10 and 11), i.e., pocket 450 may include a pocket opening that is configured to be adjustable from a first size to a second size, the second size of the opening being larger than the first size of the opening. In still another embodiment, the features of features of pocket 450 may be combined with (1) the features of pocket 390 and (2) anti-telegraphing device 420 and related attendant features (see FIG. 13).

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

The invention claimed is:

1. A pocket for a garment comprising:

a first portion;

a second portion attached to the first portion to form a partially-enclosed space, the second portion comprising a continuous exterior surface opposite the partially-enclosed space, the exterior surface comprising a first exterior surface portion and a second exterior surface portion, the partially-enclosed space comprising a region;

the region comprising a partially-enclosed subspace, the partially-enclosed subspace partially defined by an inner edge disposed proximate to an inseam of the garment;

a base edge extending from the inner edge; and a seam connecting the first portion and the second portion, the seam extending from the base edge in a direction substantially parallel to the inner edge, the seam being disposed in the partially-enclosed space and being configured and disposed to aid in orienting the object in the region; and a retaining mechanism positioned on the exterior surface of the second portion to adjust a position of the base edge and thereby adjust the size of an accessible portion of the partially-enclosed subspace;

the retaining mechanism being configured and disposed to attach the first exterior surface portion to the second exterior surface portion when the pocket is folded along an axis adjacent or intersecting the partially-enclosed subspace; and the retaining mechanism comprising a first retainer and a plurality of second retainers, the first retainer being positioned on the first exterior surface portion, the plurality of second retainers being positioned on the second exterior surface portion, each one of the plurality of second retainers corresponding to a different size of the accessible portion of the partially-enclosed subspace.

2. The pocket of claim 1, wherein the retaining mechanism comprises a plurality of gaps, each gap of the plurality of gaps being positioned between the first retainer and a second retainer of the plurality of second retainers or between two second retainers of the plurality of second retainers.

3. The pocket of claim 2, wherein each gap of the plurality of gaps corresponds to an axis adjacent or intersecting the partially-enclosed subspace to fold the pocket to attach the first exterior portion to the second exterior portion.

4. The pocket of claim 3, wherein the axis is substantially perpendicular to the inner edge.

5. The pocket of claim 1, wherein the first retainer is disposed proximate to the base edge and the inner edge.

6. The pocket of claim 5, wherein the first retainer overlies a portion of the partially-enclosed subspace.

7. The pocket of claim 5, wherein the plurality of second retainers are disposed proximate to the inner edge.

8. The pocket of claim 7, wherein the plurality of second retainers overlie a portion of the region.

9. The pocket of claim 7, wherein the plurality of second retainers overlie a portion of the partially-enclosed subspace.

10. The pocket of claim 7, wherein at least one second retainer of the plurality of second retainers overlies a portion of a second region of the partially-enclosed space different from the region.

11. The pocket of claim 2, wherein the first retainer and the plurality of second retainers are configured to enable the first retainer to be repeatedly attached and detached from each second retainer of the plurality of second retainers.

12. The pocket of claim 11, wherein the first retainer comprises one of hook-type fasteners and loop-type fasteners and each second retainer of the plurality of second retainers comprises the other of hook-type fasteners and loop-type fasteners.

13. The pocket of claim 1, wherein the plurality of second retainers form a single device.

14. The pocket of claim 11, wherein the plurality of second retainers overlie a portion of the partially-enclosed subspace, the portion of the partially-enclosed subspace comprising a plurality of subportions, each one of the plurality of subportions corresponding to a different size of the accessible portion of the partially-enclosed subspace.

15. The pocket of claim 11, wherein the plurality of second retainers overlie a first portion of the partially-enclosed subspace and overlie a second portion of a second region of the partially-enclosed space different from the region, the first portion of the partially-enclosed subspace comprising a first plurality of subportions, the second portion of the second region comprising a second plurality of subportions, each one of the first plurality of subportions and each one of the second plurality of subportions corresponding respectively to a different size of the accessible portion of the partially-enclosed subspace.

16. The pocket of claim 1, wherein the first portion and the second portion are configured and disposed to form an opening to provide access to the partially-enclosed space, the opening being configured to be adjustable from a first size to a second size, the second size of the opening being larger than the first size of the opening.

17. The pocket of claim 16, further comprising a fastener connecting the first portion and the second portion and disposed proximate to the opening, wherein upon release of the fastener, the opening is converted from the first size to the second size.

18. The pocket of claim 1, further comprising a second seam connecting the first portion and the second portion, the second seam disposed in the partially-enclosed space and intersecting the seam and being configured and disposed to guide the object into the region.

19. The pocket of claim 1, further comprising a sheet configured and disposed to assist in concealing an object in the region.

20. The pocket of claim 1, further comprising a retaining device disposed in the region, the retaining device being configured and disposed to hold a second object in a fixed position in the region.

21. The pocket of claim 20, wherein the retaining device comprises a retainer and an attachment zone, the retainer being configured to releasably retain the second object.

22. The pocket of claim 21, wherein the retainer and the attachment zone are configured to enable the retainer to be repeatedly attached and detached from the attachment zone.

23. The pocket of claim 20, wherein the retaining device is positioned adjacent a first line corresponding substantially to a line of flexion of a hip joint of a garment.

24. A garment for a person comprising:

an outer layer having an inseam;

a pocket covered by the outer layer, the pocket comprising a first part adjacent the outer layer, a second part opposite the first part and a partially-enclosed space positioned between the first part and the second part, the partially-enclosed space comprising a region partially defined by a first line corresponding substantially to a line of flexion of a hip joint of a garment;

a second line corresponding substantially to a centerline of a thigh of the garment; and a third line corresponding substantially to the inseam;

the region comprising a partially-enclosed subspace, the partially-enclosed subspace partially defined by an inner edge disposed proximate to an inseam of the garment;

a base edge extending from the inner edge; and a seam extending from the base edge in a direction substantially parallel to the inner edge, the seam being disposed in the partially-enclosed space and being configured and disposed to aid in orienting the object in the region;

a retaining mechanism configured and disposed to adjust a position of the base edge and thereby adjust a size of an accessible portion of the partially-enclosed subspace, the retaining mechanism comprising a first portion, a second portion and a third portion each positioned on the second part;

the retaining mechanism being configured and disposed to attach the first portion to the second portion when the pocket is folded along a first axis adjacent or intersecting the partially-enclosed subspace; and the retaining mechanism being configured and disposed to attach the first portion to the third portion when the pocket is folded along a second axis adjacent or intersecting the partially-enclosed subspace.

25. The garment of claim 24, wherein the accessible portion of the partially-enclosed subspace has a first size when the first portion is not attached to another portion and the accessible portion of the partially-enclosed subspace has a second size when the first portion is attached to the second portion, the first size being greater than the second size.

26. The garment of claim 25, wherein the accessible portion of the partially-enclosed subspace has a third size when the first portion is attached to the third portion, the second size being greater than the third size.

27. The garment of claim 24, wherein the pocket comprises an opening to provide access to the partially-enclosed space, the opening being configured to be adjustable from a first size to a second size, the second size of the opening being larger than the first size of the opening.

28. The garment of claim 24, further comprising a retaining device disposed in the region, the retaining device being configured and disposed to hold a second object in a fixed position in the region.

* * * * *